US008757324B2

(12) United States Patent
Renton et al.

(10) Patent No.: US 8,757,324 B2
(45) Date of Patent: Jun. 24, 2014

(54) HEIGHT RESCUE APPARATUS

(76) Inventors: Julian Elwyn Renton, Wiltshire (GB); Peter Thomas Mence Nott, Wiltshire (GB)

( * ) Notice: Subject to any disclaimer, the term of this patent is extended or adjusted under 35 U.S.C. 154(b) by 877 days.

(21) Appl. No.: 12/733,315

(22) PCT Filed: Aug. 24, 2007

(86) PCT No.: PCT/GB2007/050507

§ 371 (c)(1),
(2), (4) Date: May 7, 2010

(87) PCT Pub. No.: WO2009/027619

PCT Pub. Date: Mar. 5, 2009

(65) Prior Publication Data

US 2010/0282541 A1 Nov. 11, 2010

(51) Int. Cl.
*A62B 1/10* (2006.01)

(52) U.S. Cl.
USPC ..... 182/234; 182/231; 182/232

(58) Field of Classification Search
USPC ..... 182/235, 73, 240, 71, 72, 231–234, 182/236–239
See application file for complete search history.

(56) References Cited

U.S. PATENT DOCUMENTS

| | | | | | |
|---|---|---|---|---|---|
| 939,375 | A * | 11/1909 | Andrews | 182/232 |
| 2,680,593 | A * | 6/1954 | McIntyre | 182/231 |
| 3,915,432 | A * | 10/1975 | Bustamante | 182/239 |
| 5,233,942 | A * | 8/1993 | Cooper et al. | 119/792 |
| 5,682,962 | A * | 11/1997 | Lo | 182/240 |
| 7,278,601 | B2 * | 10/2007 | Xiaolin | 242/390.9 |
| 7,481,399 | B2 * | 1/2009 | Nohren et al. | 244/122 R |
| 2003/0145799 | A1 * | 8/2003 | Hays et al. | 119/502 |
| 2005/0217937 | A1 * | 10/2005 | Rohlf | 182/232 |
| 2006/0137625 | A1 * | 6/2006 | Conte | 119/858 |
| 2007/0158139 | A1 * | 7/2007 | Moon et al. | 182/238 |
| 2009/0173578 | A1 * | 7/2009 | Renton et al. | 182/235 |
| 2011/0174238 | A1 * | 7/2011 | Dagnon | 119/794 |
| 2013/0200172 | A1 * | 8/2013 | Downer | 239/6 |

FOREIGN PATENT DOCUMENTS

| | | | |
|---|---|---|---|
| GB | 2 414 005 A | 11/2005 | |
| GB | 2414005 A * | 11/2005 | A62B 35/04 |

* cited by examiner

*Primary Examiner* — Katherine Mitchell
*Assistant Examiner* — Candace L Bradford
(74) *Attorney, Agent, or Firm* — Carmody Torrance Sandak & Hennessey LLP

(57) ABSTRACT

There is provided a height rescue apparatus (4) comprising a flexible load element (6) for attachment at end (6*a*) to a safety line (3). The other end is attached to a flexible elongate element (10) wound on a drum (8) which is part of a speed control means. A flexible harness element (7*a*) is attached to a bracket (11) and is connected to a harness (2) arrangement. The flexible load element (6) is releasably connected to the bracket (11) and is intended to take the fall loads associated with a user falling. After such a fall the load element is released to allow a controlled descent using the elongate element (10) and the speed control means.

29 Claims, 16 Drawing Sheets

HEIGHT RESCUE APPARATUS

CROSS REFERENCE TO RELATED APPLICATIONS

This application is a National Stage application of International Application No. PCT/GB2007/050507, filed Aug. 24, 2007, the subject matter of which is incorporated by reference in its entirety.

This invention relates to a person being arrested following a fall from height whilst attached to fall arrest equipment and also to the rescue of the person following suspension at height as a result of such fall. In particular, this invention relates to a height rescue apparatus that is physically associated with a person whilst working normally at height and also, in the event of the person being arrested and suspended following a fall from height, provides a means for lowering the person to safety whether it be to the ground or some other safe level.

UK Patent Application GB 2414005 discloses a height rescue apparatus comprising a casing, which incorporates a bracket for attachment to a person's body harness whereby the bracket can be releasably attached to a load element attached to a safety line and the safety line may then be attached to a secure anchorage. Various release mechanisms are disclosed including release that is initiated remotely such as by the transmission and receipt of radio signals. The receipt of radio signals may be used to initiate the activation of an actuator that can then carry out the release operation. An example given of a typical actuator is a pyrotechnic actuator that is initiated electrically. When the load element is released from the bracket, elongate that is also attached to the load element is deployed at a speed controlled by a speed control means thereby controlling the descent of the person being rescued.

When a person is arrested after a fall, the bracket for attaching to the person's harness and the load element releasably attached to the bracket should ideally be arranged so that when fall loads of up to 6 kN are applied between the harness and safety line, loading between the bracket and the load element is aligned as closely as is practical in order to minimise any load transference from the bracket to the casing, tending to rotate the casing. Rotation of the casing towards a person whilst being arrested from a fall could injure the person. Also, if the load transference between the bracket and the casing is small, the casing can be a lightweight construction and therefore more comfortable to wear routinely on a harness. A factor complicating load alignment between the bracket and the load element is that a person can fall in various attitudes such as feet first, head first and prone.

UK Patent Application GB 2414005 discloses load elements between the harness and the safety line that are pivotally interconnected in order to minimise load misalignment tending to rotate the casing in different fall attitudes. However, each element and its pivotal attachment needs to be relatively heavy and expensive to manufacture as a result of a requirement for loading between the harness and safety to be sustainable at 22 kN in order to comply with safety margin requirements. The same applies to the construction of the bracket and its release means. Accordingly, one object of this invention is to provide a bracket, harness attachment and load element attached to the safety line that are light weight, simple and cost effective to manufacture and will not present rigid surfaces that could injure a person whilst falling.

Whilst UK Patent Application GB 2414005 discloses electrical initiation of the activation of the release means, there are no detail embodiments for achieving this. Therefore, a further objective of this invention is to provide specific embodiments for the release means.

This invention also discloses methods of attaching the rescue apparatus to a harness in normal use whereby the weight of the rescue apparatus is supported at least in part by alternative means other than the load elements between the harness and the safety line so it can be aligned with the harness to achieve a comfortable arrangement when worn with the harness and also to minimise exposure to being knocked in day to day use. However, the load elements between the harness and the safety are in use in the event of a fall, subsequent suspension and rescue descent.

According to the present invention there is provided a height rescue apparatus comprising a first flexible elongate element releasably secured to a bracket, a second flexible elongate element attached in use to both the bracket and a harness, a safety line having one end attached to the first flexible elongate element, the other end in use being attached to a secure anchorage, a third flexible elongate element being secured at one end to the first flexible elongate load element and at the other end to at least one speed control means, release means for releasing the first flexible elongate element from the bracket such that when the first flexible elongate element is released the first and third elongate elements are able to move relative to the bracket at a controllable speed so as to provide a controlled speed of descent. The use of flexible elongate for the first and second flexible elongate elements enables both elements to align due to their flexibility with applied fall loads whilst minimising the transference of load tending to rotate the bracket. Any or all flexible elongates may be made from modern high strength polymers to provide a substantially lighter solution than metal equivalents and have any suitable cross section and construction. The bracket is typically secured within casing and the casing may be used to protect the speed control mechanism and the third elongate element from accidental damage and weathering prior to the need for the height rescue apparatus to rescue a person suspended at height.

When a person is arrested from a fall from height, the mental and physical demands can be debilitating making it difficult for the person to subsequently operate his or her own height rescue apparatus to initiate the controlled descent to a safe level. It is therefore beneficial, and in some cases essential, to provide for the release operation to be capable of initiation by a second person but without endangering the life of the second person. Accordingly, the height rescue apparatus may have a release means that is capable of being released remotely. Typical embodiments comprise a portable transmitting unit with its own electrical energy source operable to transmit signals such as light or radio waves and normally physically remote from the height rescue apparatus worn on a harness, a receiver capable of receiving said signals that is typically enclosed within the casing of the height rescue apparatus, a source of electrical energy, an electrical switch that may be controlled by the receiver, an electrically initiated actuator to effect the release means, so that when a person is suspended at height requiring to be lowered to the ground, the transmitting unit is operated to transmit signals that are received by the receiver that then controls the switch to send electrical current to the electrically initiated actuator to activate release of the release means. The source of electric energy is typically one or more batteries contained with the casing. In practical trials it has been found that battery weight savings can be made by incorporating a capacitor that can be charged by a relatively small energy source so that the capacitor can then discharge comparatively high energy to initiate the actuator to release the release means. In a further embodiment of this invention, the electrical circuit may be arranged to remain open in normal use thereby preventing electrical energy to drain from the source of electrical energy. However, in the event that there is load between the harness and safety line exceeding a predetermined limit as would occur if someone were suspended, an electrical switch closes to allow the source of electrical energy to energize the electrical circuit. This has the advantage of enabling the electrical power source to be in service for a long duration before being depleted. When several height rescue apparatuses are worn by a group of people using common transmitters, receivers and encoded signals, any release means can only be activated when a person is suspended or applying load between their harness and safety line thus avoiding the possibility of activating the release means in height rescue apparatuses where people are not suspended. Use of common transmitters, receivers and encoded signals also avoids practical complications arising from the need to pair each transmitting unit with a specific receiving unit.

In practical trials, it has been found that a pyrotechnic actuator is a useful actuator for actuating release of the release means because it is capable of delivering a high level of mechanical energy relative to its weight, size and cost. Such pyrotechnic actuators are typically detonated by a mechanical action such as the firing mechanism in a gun or, more usefully, by an electric current that heats a bridge wire that in turn detonates explosive material within the actuator. Electrically detonated types of pyrotechnic actuator typically require relatively small amounts of electrical energy to initiate detonation and are routinely used in the automotive industry to fulfil safety functions such as initiating the inflation of air bags and pre-tensioning safety belts in the event of a collision, and so their development has lead to products that are very reliable and consistent in their performance.

In an alternative embodiment, the height rescue apparatus may be substantially supported by a secure anchorage rather than by a person wearing a harness. In such an embodiment, the height rescue apparatus may comprise a first flexible elongate element releasably secured to a bracket, a second flexible elongate element attached in use to both the bracket and a secure anchorage, a safety line having one end attached to the first flexible elongate element, the other end in use being attached to a harness, a third flexible elongate element being secured at one end to the first flexible elongate element and at the other end to at least one speed control means, release means for releasing the first flexible elongate element from the bracket such that when the first flexible elongate element is released the first and third flexible elongate elements are able to move relative to the bracket at a controllable speed so as to provide a controlled speed of descent. This embodiment has the advantage that a person does not need to carry the height rescue apparatus in use. In this embodiment, the bracket remains substantially stationary relative to the secure anchorage and the first and third flexible elongates move relative to the secure anchorage during the descent. Clearly, a further embodiment is possible where the at least one speed control means may instead be arranged to move relative to the secure anchorage by attaching the first flexible elongate element to the secure anchorage instead of to a safety line attached to a harness and by attaching the second flexible elongate element to a safety line attached to a harness instead of to a secure anchorage. In practice, it is usually preferable for the at least one speed control means to remain stationary with respect to the secure anchorage to avoid the possibility that any speed control means may be damaged if it were to move over an edge or collide with an obstruction.

The invention will now be described by way of example only with references to the accompanying diagrammatic figures, in which:

FIG. 1*a* shows a height rescue apparatus worn by a person;

FIG. 1*b* shows a height rescue apparatus worn by a person suspended at height after being arrested from a fall;

Figure 6A:
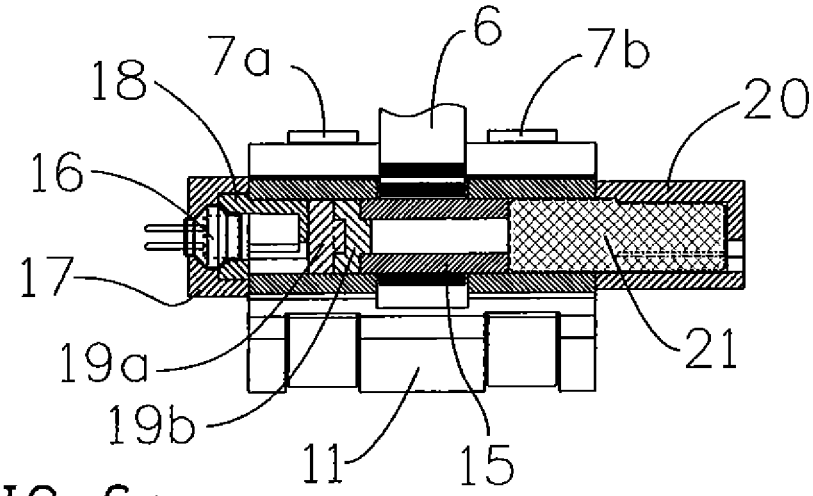
Figure 6B:
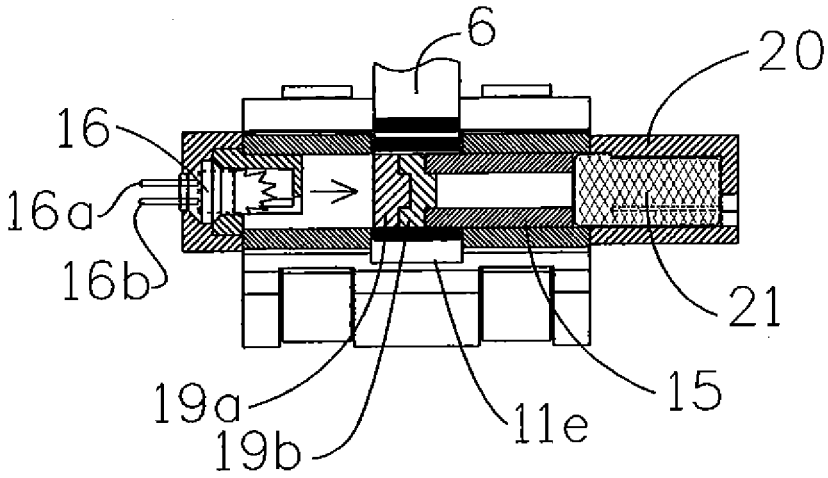
Figure 6C:
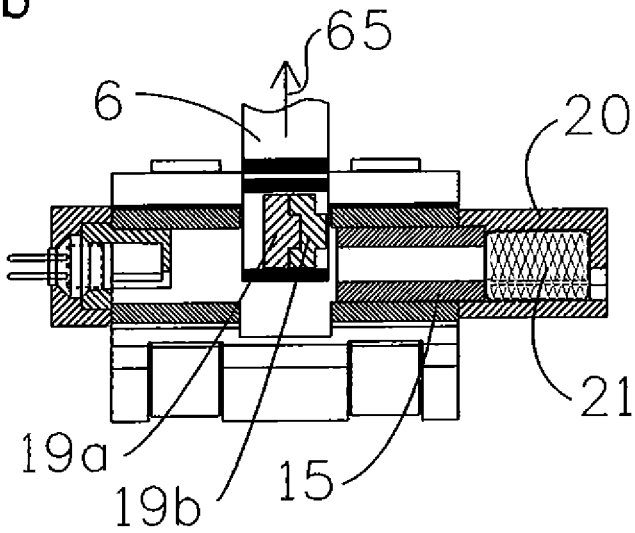
Figure 7B:
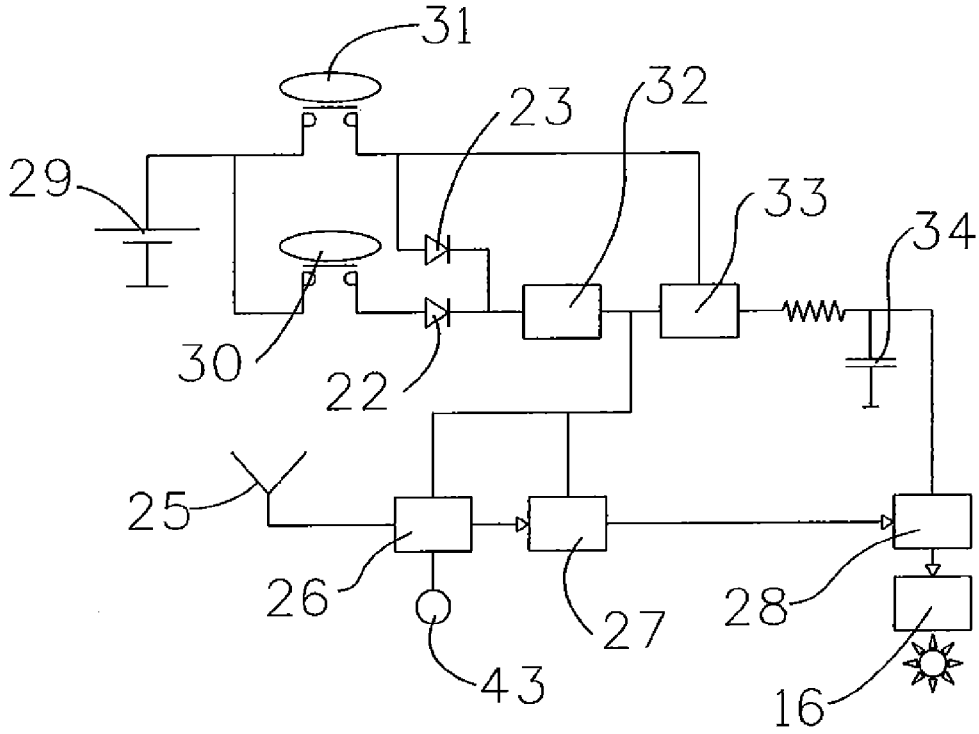
Figure 7A:
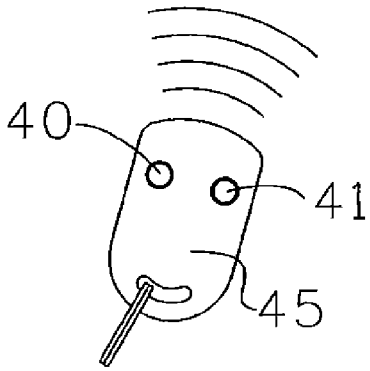
Figure 7C:
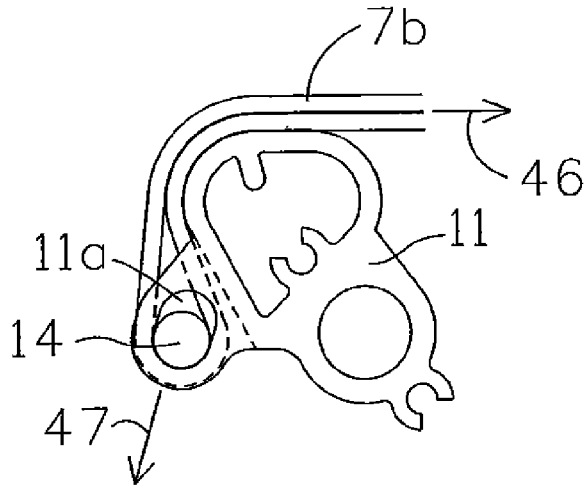
Figure 7D:
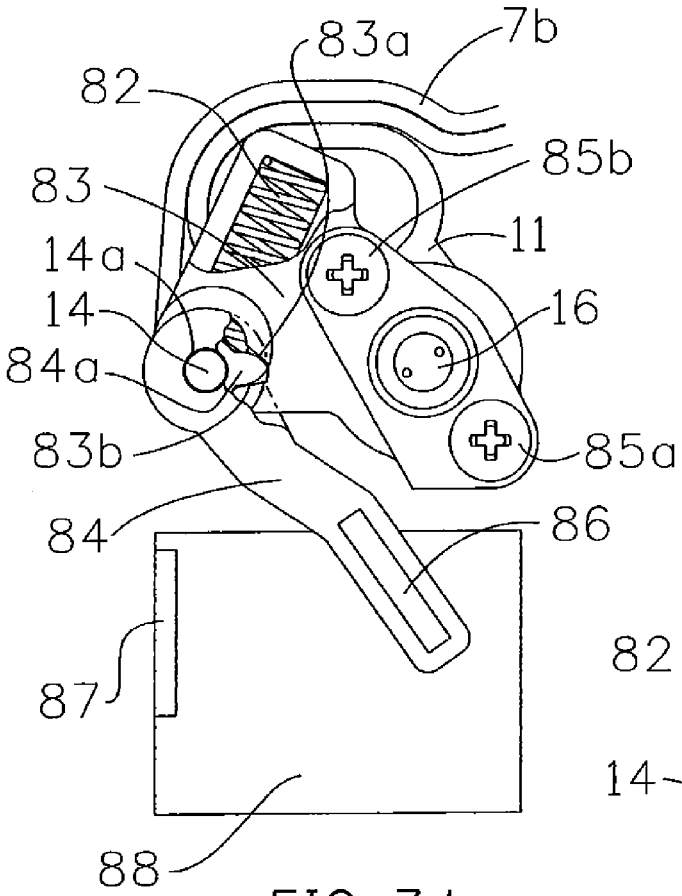
Figure 7E:
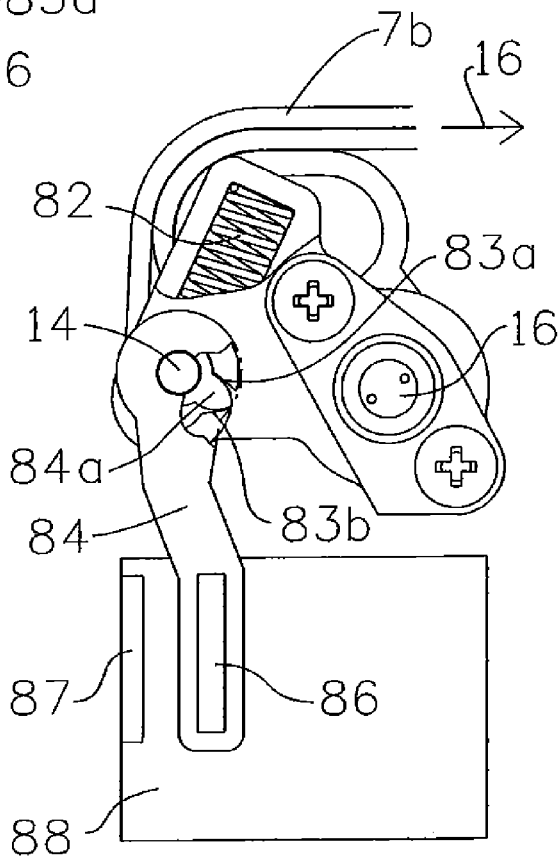

FIG. 6*a* shows a cut away view of the release means;

FIG. 6*b* shows the embodiment in FIG. 6*a* in a first level of operation;

FIG. 6*c* shows the embodiment in FIG. 6*a* in a second level of operation;

FIG. 7*a* shows a typical radio transmitter for sending radio signals;

FIG. 7*b* shows a diagram summarising the electrical circuit for initiating activation of the release means;

FIG. 7*c* shows a cut away detail view of an embodiment for enabling/closing the electrical circuit in FIG. 7*b* when a person is suspended;

FIG. 7*d* shows further detail of the embodiment in FIG. 7*c* in a first level of operation;

FIG. 7*e* shows the embodiment in FIG. 7*d* in a second level of operation.

Figure 8A:
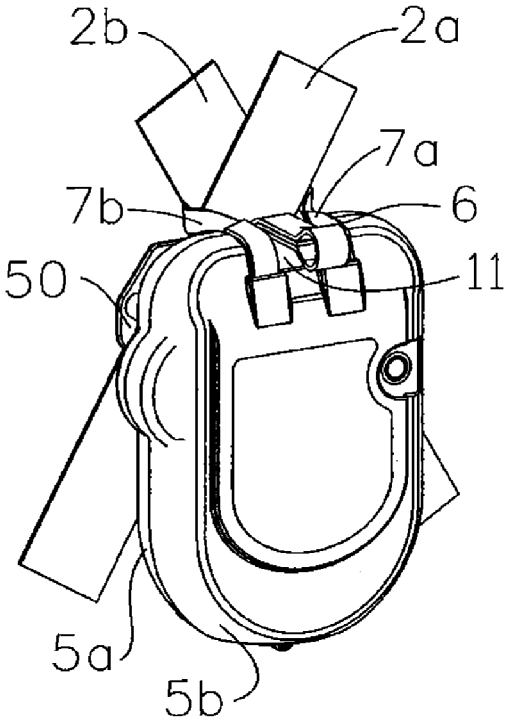
Figure 8B:
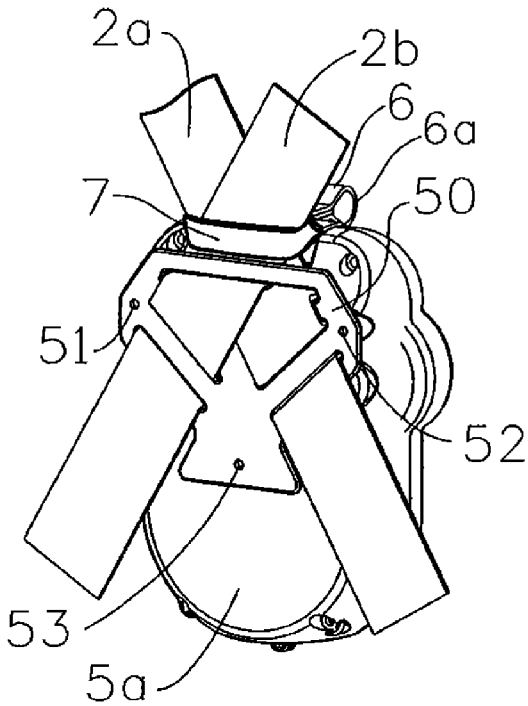

FIG. 8*a* shows a view of the invention attached to the webbing straps of a typical harness;

FIG. 8*b* shows a further view of the embodiment in FIG. 8*a;*

Figure 9A:
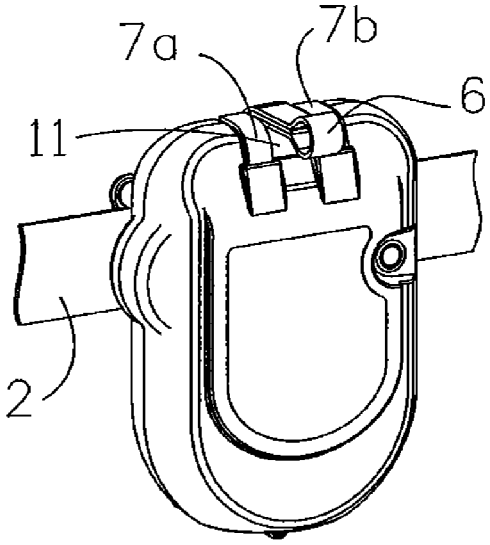
Figure 9B:
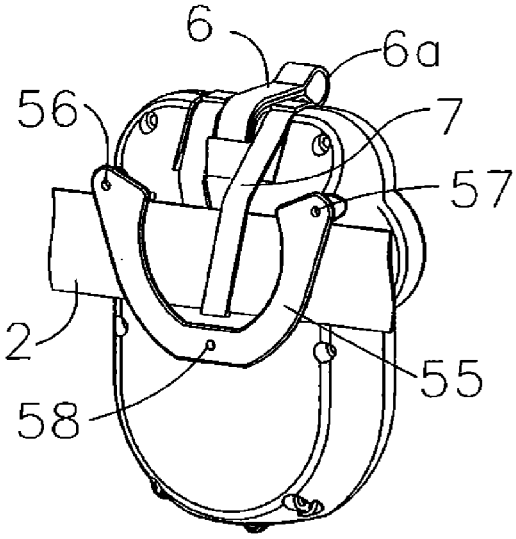

FIG. 9*a* shows a view of the invention attached to a horizontal webbing strap of a typical harness;

FIG. 9*b* shows a further view of the embodiment in FIG. 9*a;*

Figure 10A:
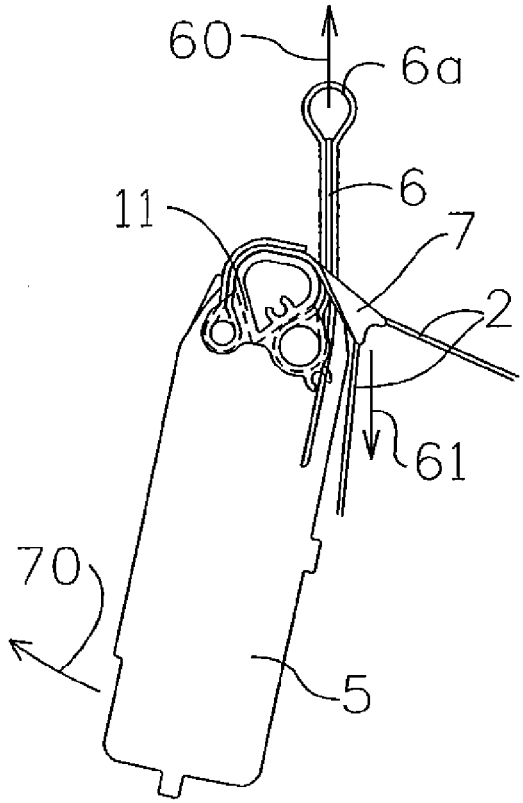
Figure 10B:
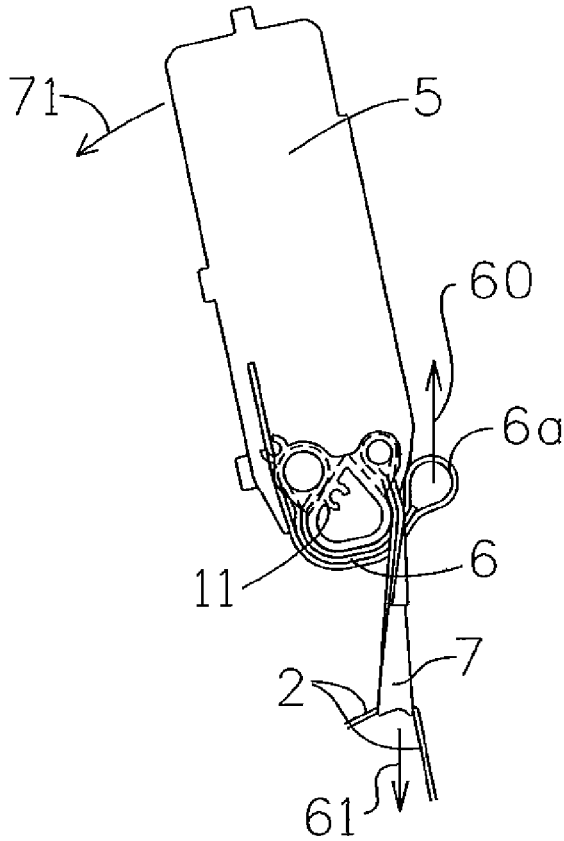
Figure 10C:
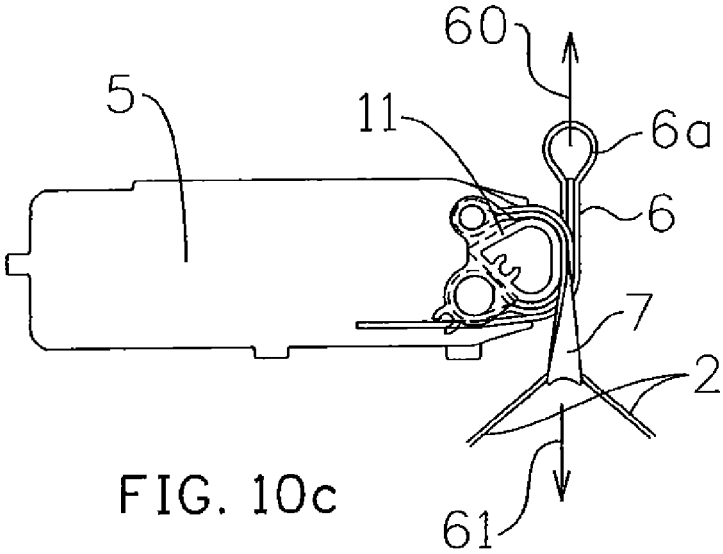
Figure 11A:
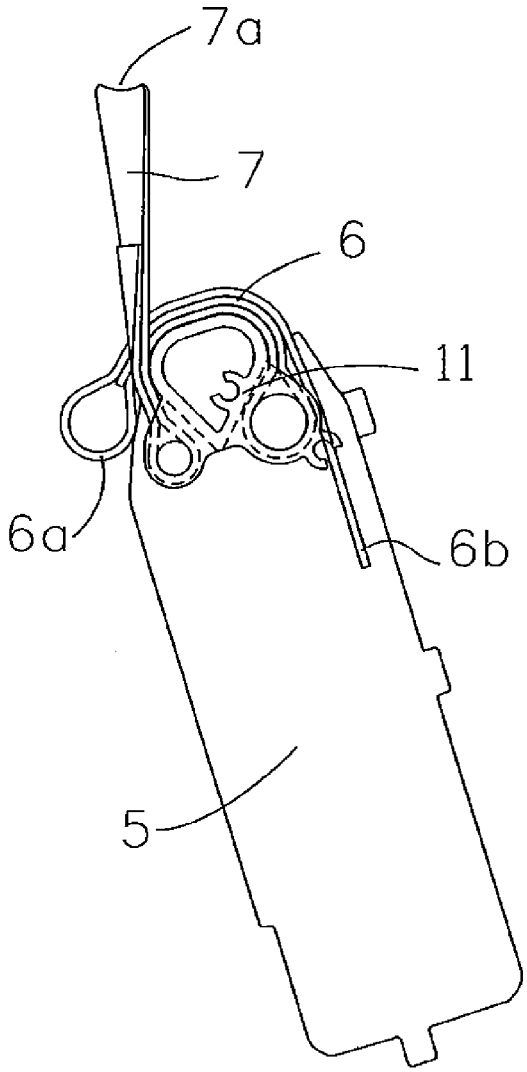
Figure 11B:
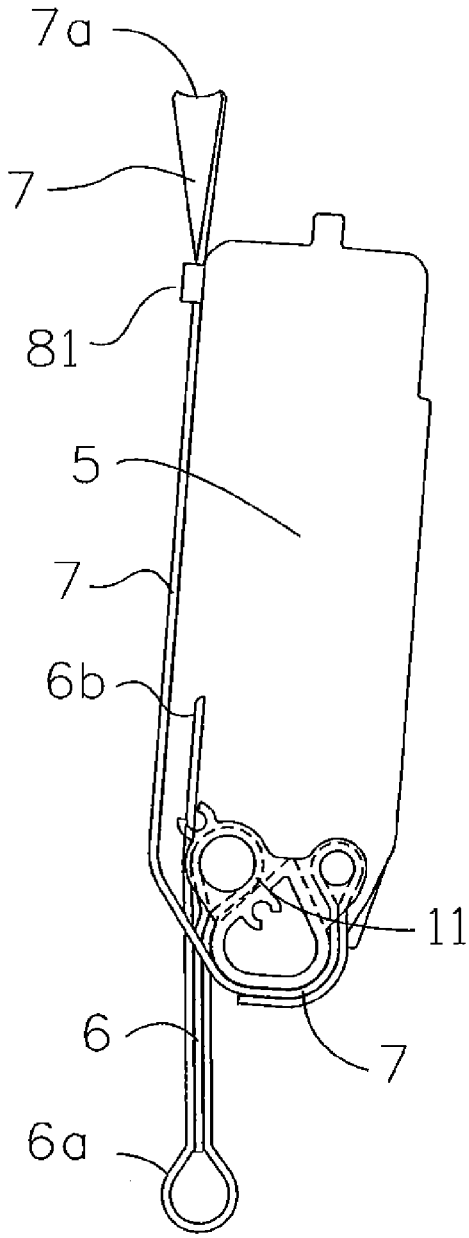
Figure 12A:
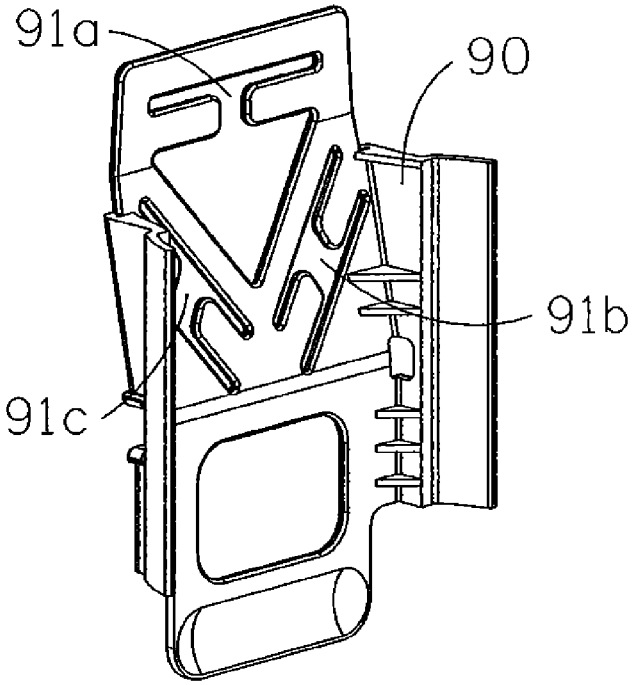
Figure 12B:
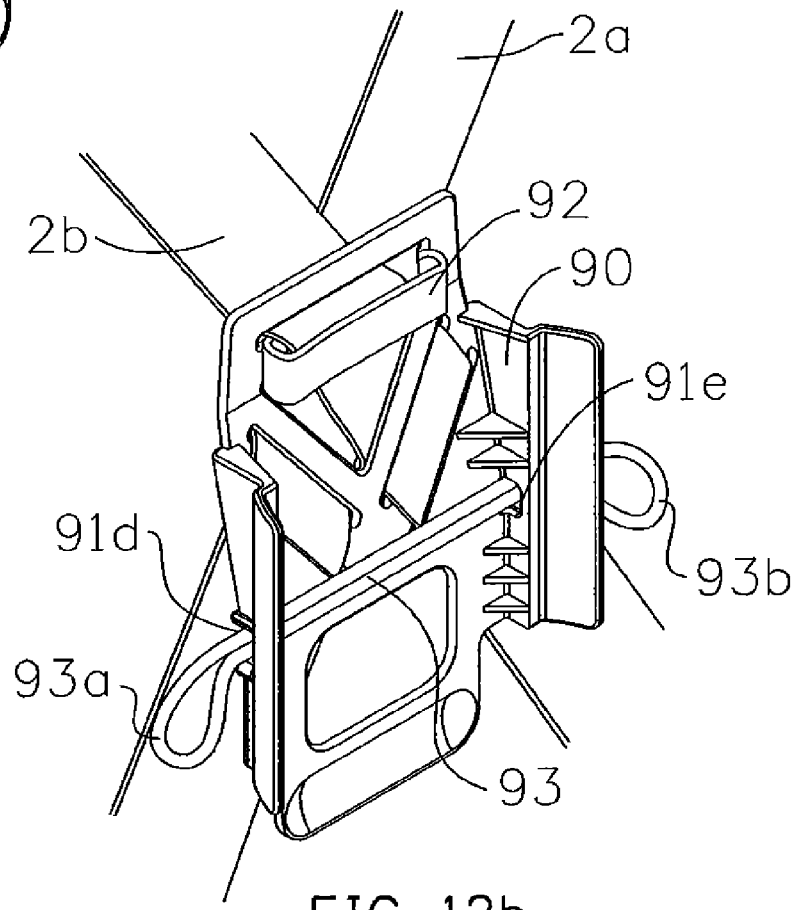
Figure 12C:
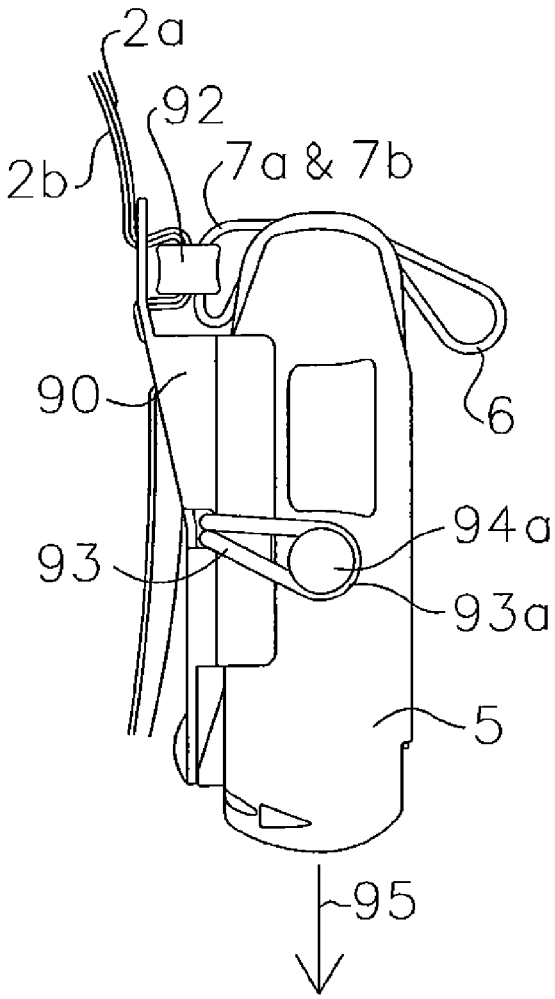
Figure 12D:
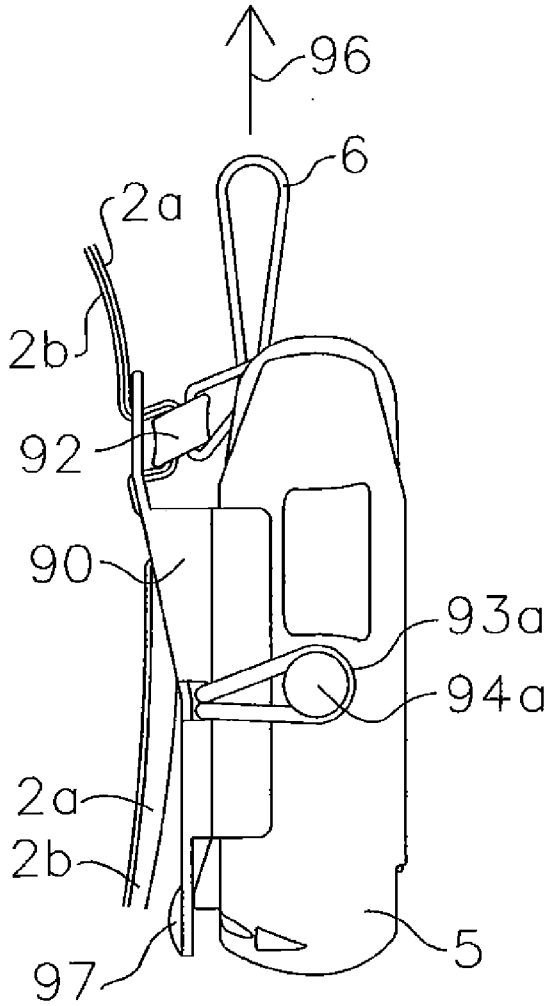
Figure 13A:
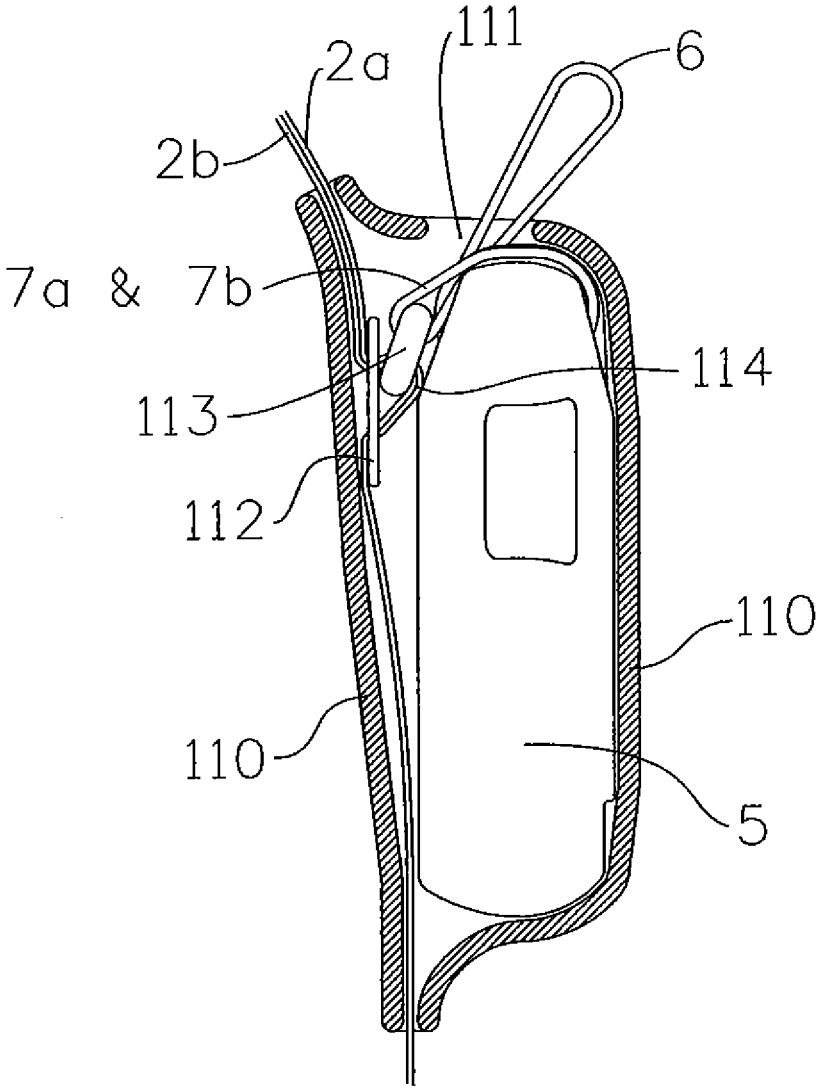
Figure 13B:
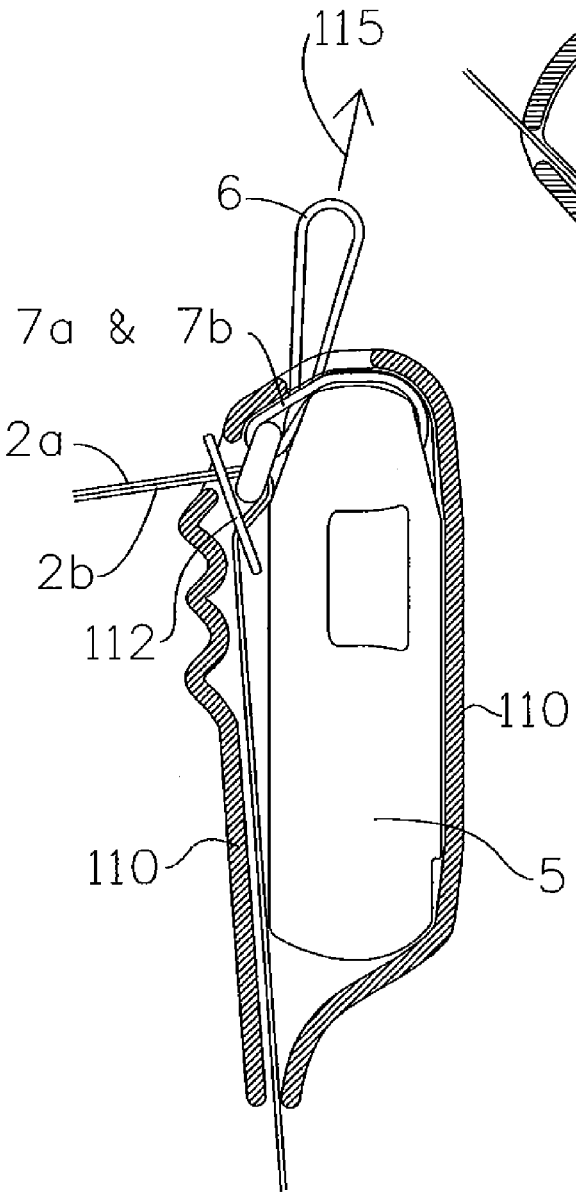
Figure 13C:
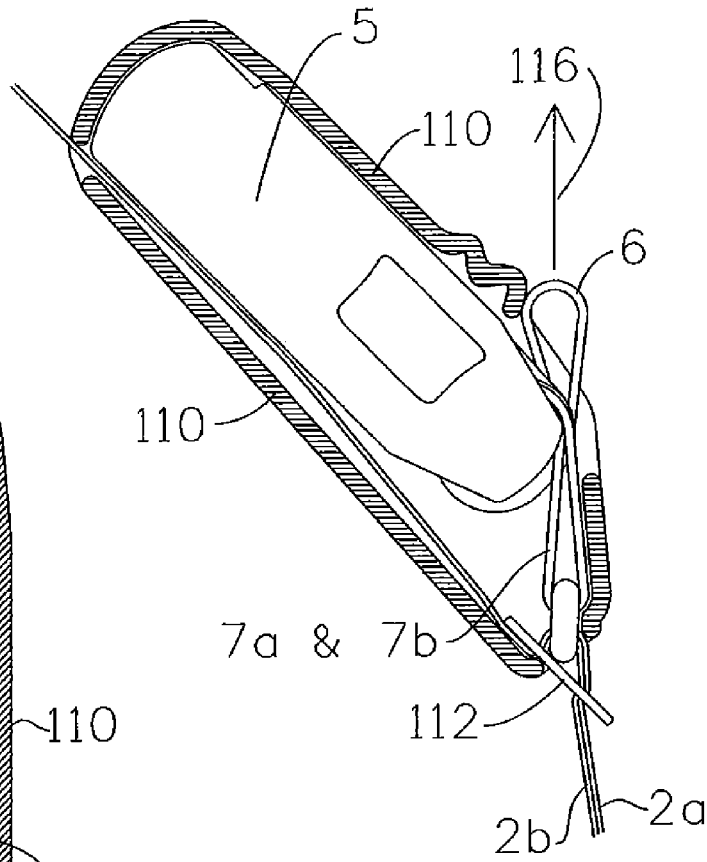
Figure 13D:
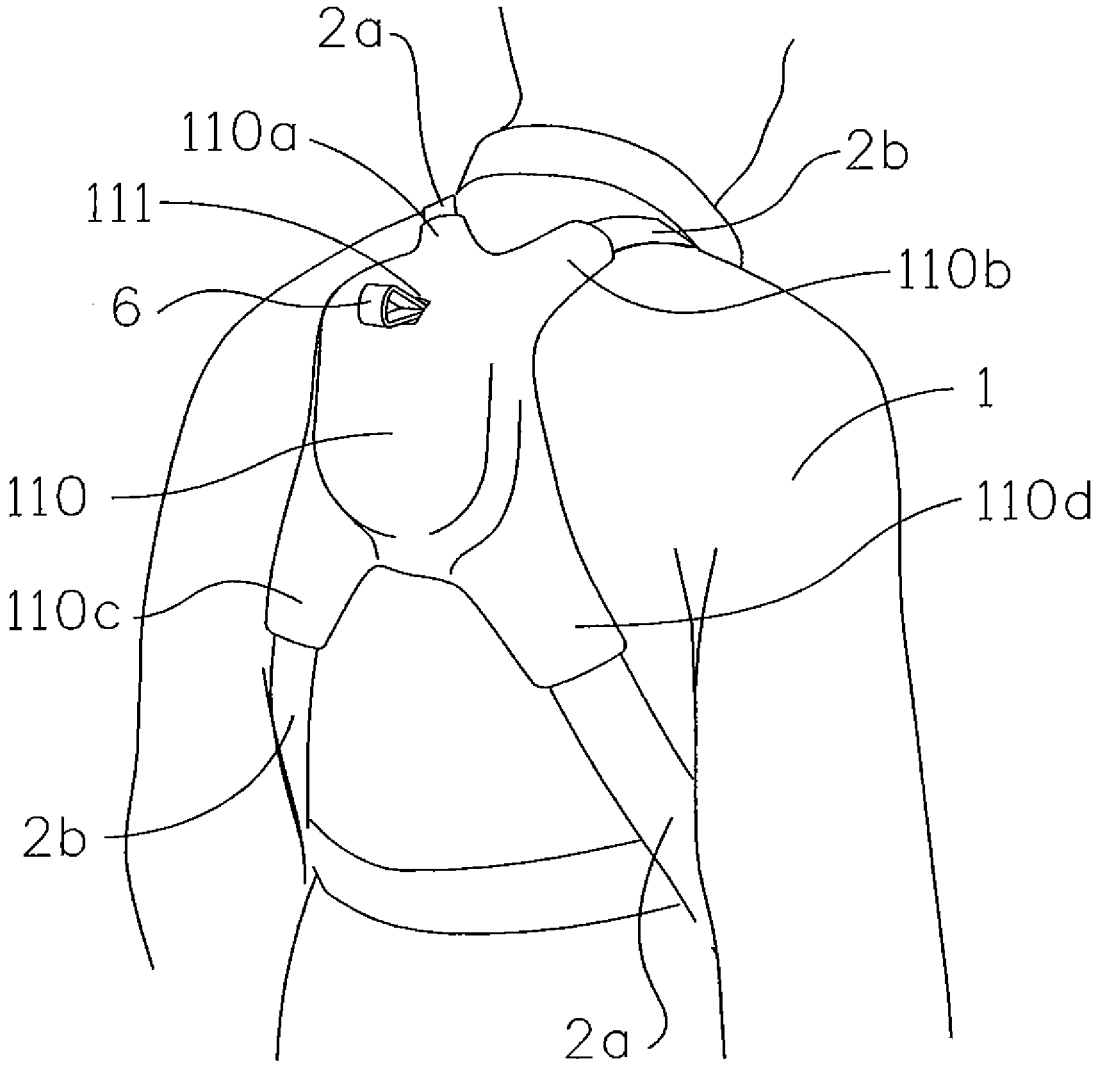
Figure 14:
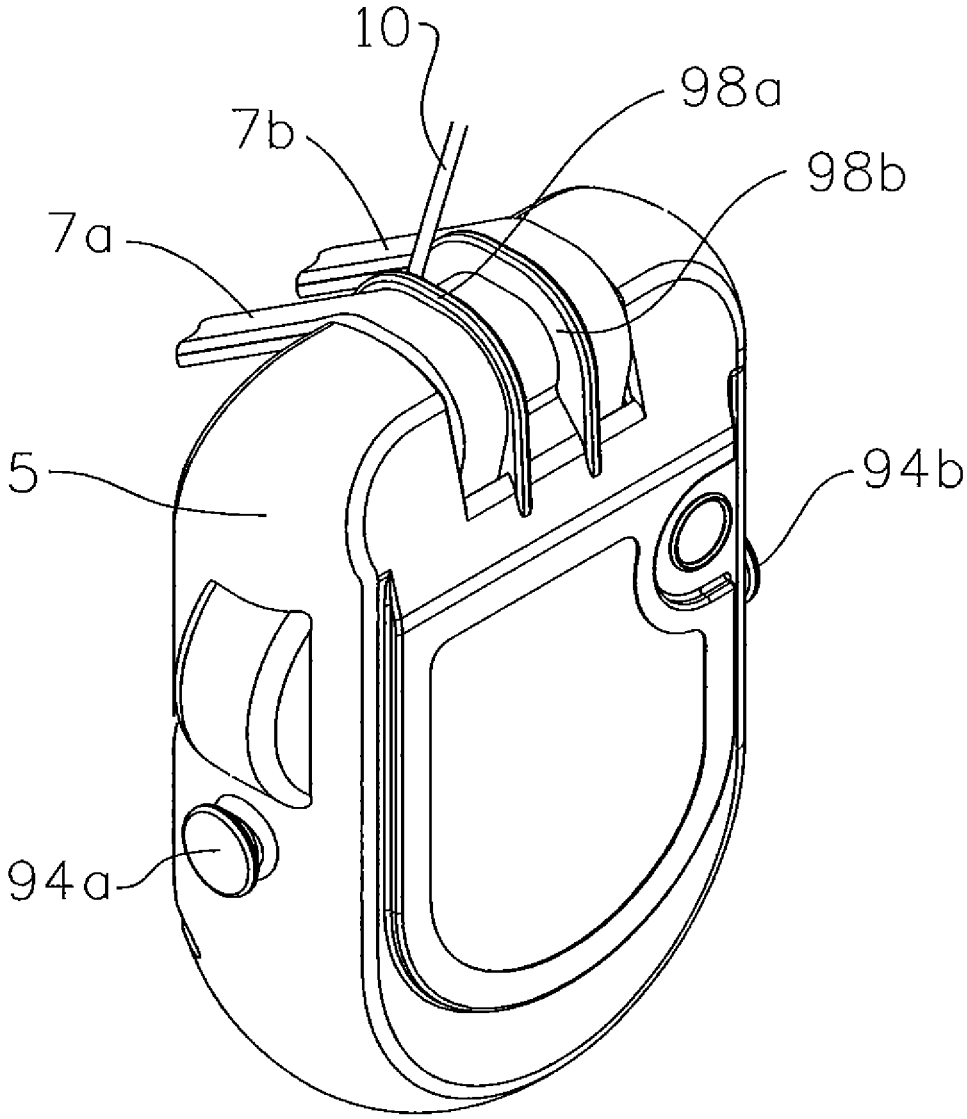

FIG. 10*a* shows a view of the invention and particularly the interrelationship between the first and second flexible elongate elements when a person is arrested from a fall with the person's feet closest to the ground and preceding the rest of the person's body;

FIG. 10*b* shows the embodiment in FIG. 10*a* except where the person is arrested from a fall with the person's head closest to the ground preceding the rest of the person's body;

FIG. 10*c* shows the embodiment in FIG. 10*a* except where the person is arrested from a fall with the person's body orientated initially in a substantially prone position;

FIG. 11*a* shows a view of the invention with the second flexible elongate element attached to a secure anchorage instead of to a harness and with the first flexible elongate element attached to a safety line enabling the invention to be supported by a secure anchorage instead of by a person wearing a harness;

FIG. 11*b* shows the embodiment in FIG. 11*a* but with the casing in a different position relative to the secure anchorage;

FIG. 12*a* shows a view of a bracket for attaching to a harness;

FIG. 12*b* shows a view of the bracket in FIG. 12*a* attached to a harness and also a means for securing the height rescue apparatus casing to said bracket;

FIG. 12*c* shows a side elevation of the height rescue apparatus attached to the bracket in FIG. 12*b* and in a first level of operation;

FIG. 12*d* shows a side elevation of the invention in FIG. 12*c* in a second level of operation;

FIG. 13*a* shows a side elevation of the height rescue apparatus attached to a harness and held within a flexible pouch in normal use;

FIG. 13*b* shows a side elevation of the invention in FIG. 13*a* illustrating the invention in FIG. 13*a* when under load with a person suspended head up;

FIG. 13*c* shows a side elevation of the invention in FIG. 13*a* illustrating the invention in FIG. 13*a* when under load with a person head down during a fall;

FIG. 13*d* shows an embodiment of the invention in FIG. 13*a* as worn by a person;

FIG. 14 shows a view of the invention during the descent operation.

Figure 1A:
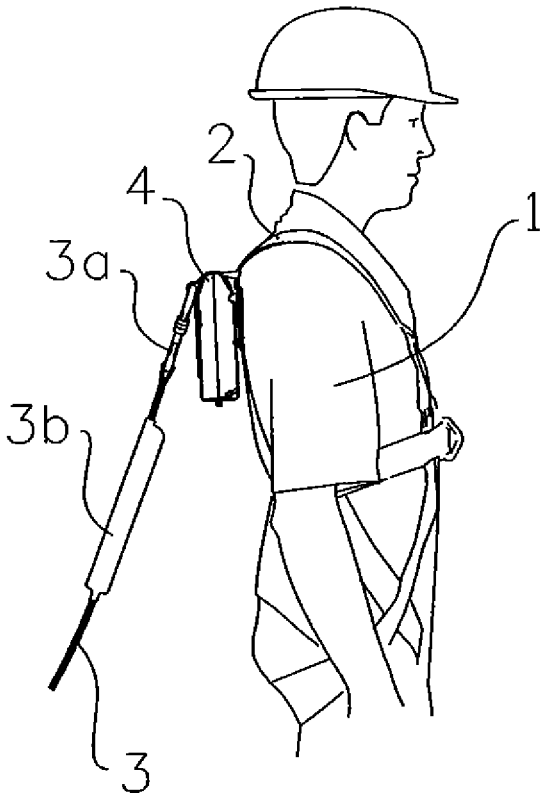
Figure 1B:
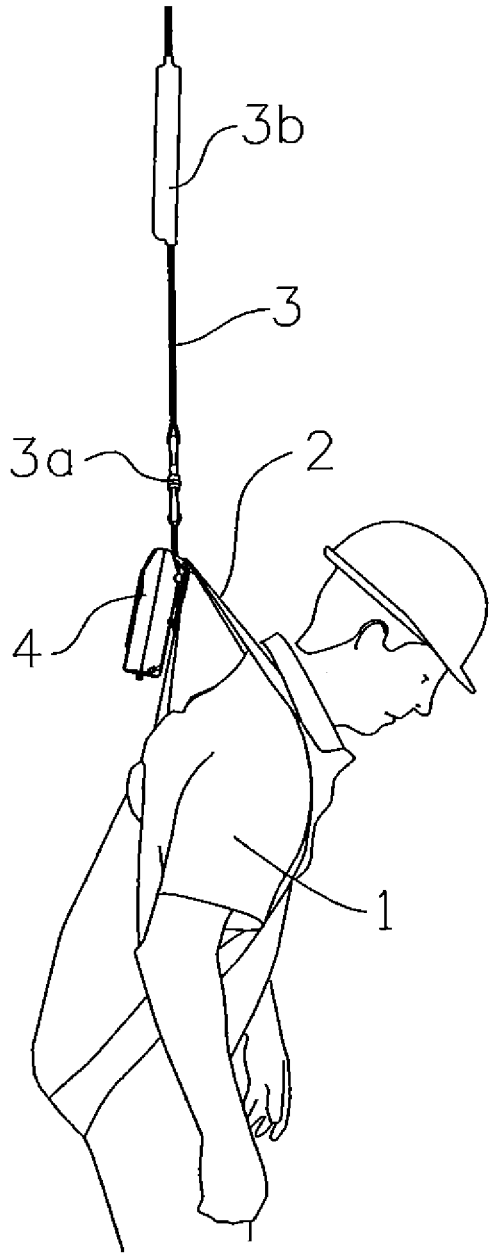

FIGS. 1*a* and 1*b* show person 1 wearing an embodiment of the rescue apparatus 4 on a body harness 2 with rescue apparatus 4 attached to both harness 2 and safety line 3, safety line 3 being attached to a secure anchor or to a fall arrest system that may be attached to one more secure anchors. In FIG. 1*a* person 1 is shown wearing rescue apparatus 4 before a fall event whereas, in FIG. 1*b* person 1 is shown suspended attached to safety line 3 after having being arrested from a fall. Energy absorber 3*b* is a commonly used energy absorber that may be integral with safety line and is deployed whilst arresting a person from a fall to limit the resulting fall load sustained by the person. Karabiner 3*a* is a typical means for attaching safety line 3 to rescue apparatus 4.

Figure 2:
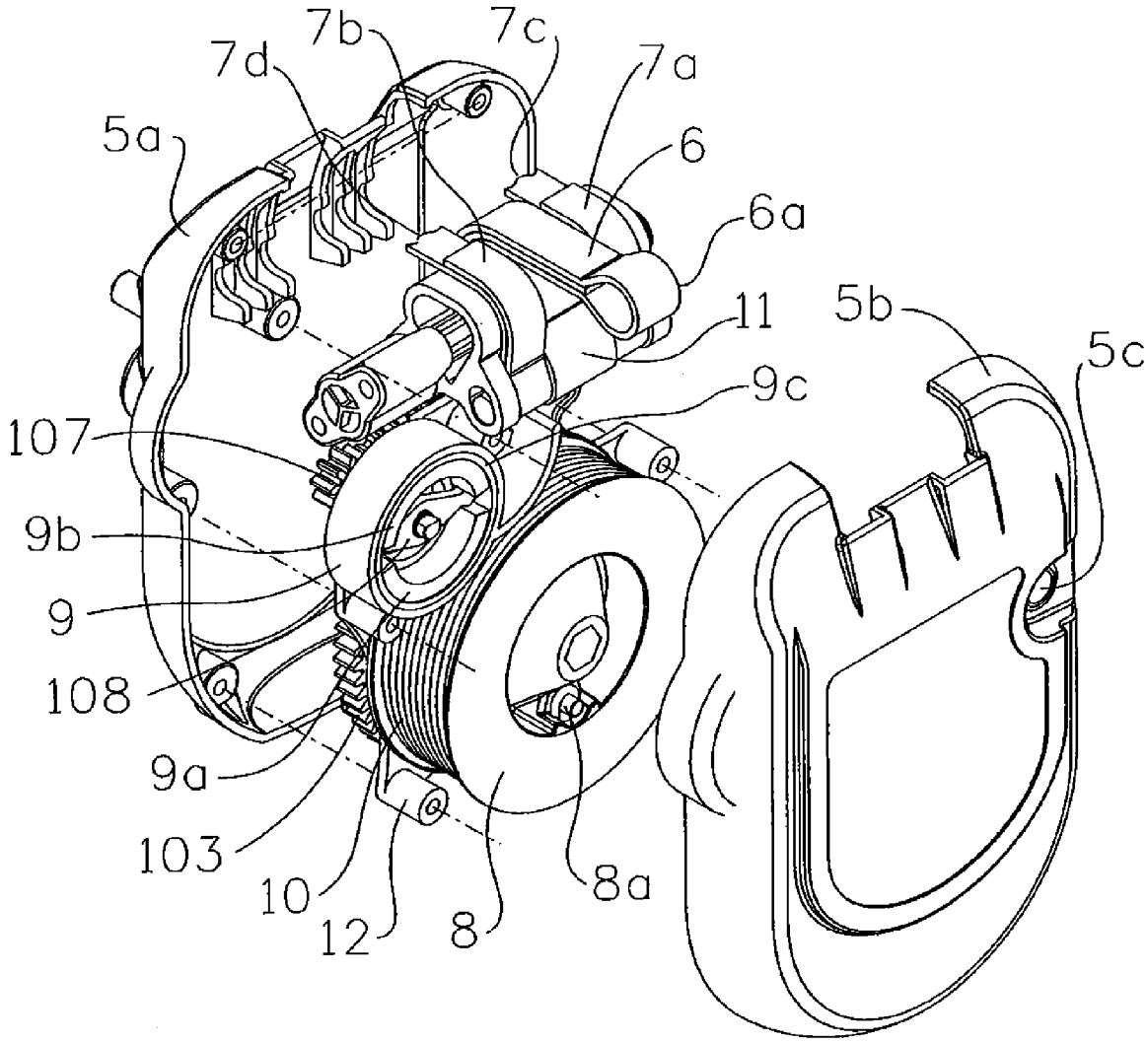
FIG. 2 shows a view of an embodiment of the invention with the casing disassembled.
Figure 3:
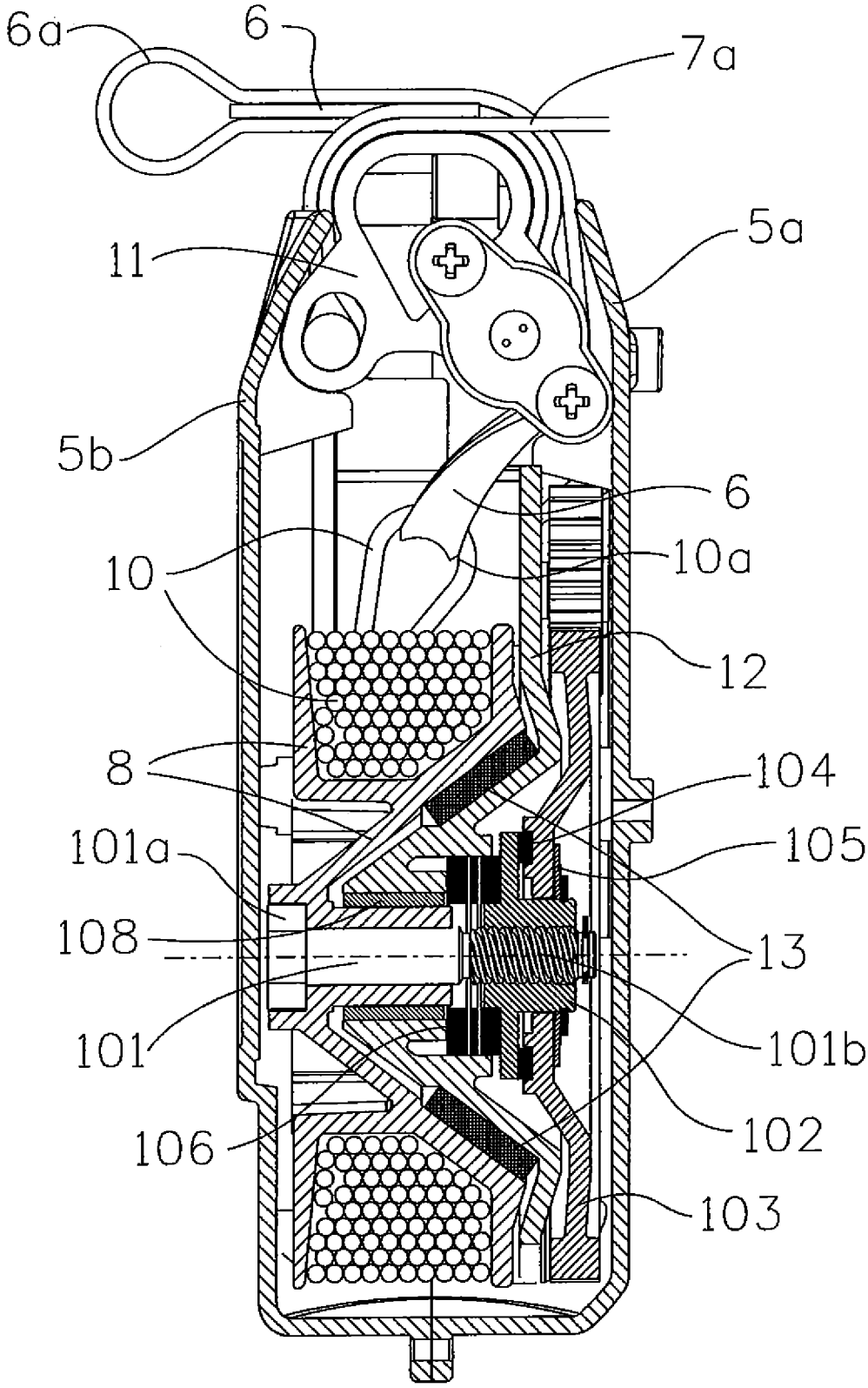
FIG. 3 shows a partially cut away view in elevation of the embodiment in FIG. 2.

FIG. 2 shows casing 5*a* and 5*b* disassembled to reveal typical internal components of the height rescue apparatus 4 in FIGS. 1*a* and 1*b* and FIG. 3 shows an elevation of the invention in FIG. 2 whereby the speed control assembly and casing 5*a* and 5*b* are cut away substantially through the central axis of drum 8. In both FIGS. 2 and 3, flexible elongate 10 is a length of flexible elongate wound helically around a drum 8 and with one end of the elongate being attached to drum 8, shown in FIG. 2 at attachment 8*a*, and at the other end securely attached to one end of flexible elongate 6 shown as interlinking closed loops such as 10*a* in FIG. 3. Flexible elongate 6 is releasably attached to bracket 11 and has a loop 6*a* to which safety line 3 in FIGS. 1*a* and 1*b* is attached. Flexible elongates 7*a* and 7*b* are flexible elongates with one end of each securely attached to bracket 11 and the other end of each being securely attached to harness 2 in FIGS. 1*a* and 1*b*. The attachment of elongate 7*a* and 7*b* to harness 2 may be achieved in various ways including, for example, an intermediate buckle to which both the harness and elongates 7*a* and 7*b* are attached and, in another example where such a buckle may have the ability to be opened to simplify the means of attachment, or in a further example attachment of elongates 7*a* and 7*b* to harness 2 may be achieved as shown in FIGS. 9*a* to 10*b* where elongates 7*a* and 7*b* are parts of one and the same elongate element. Bracket 11 is normally secured to and/or within both casing 5*a* and 5*b* particularly when casing 5*a* and 5*b* are attached together on assembly.

When flexible elongate 6 is released from bracket 11 in order to lower person 1 to safety after being suspended following a fall from height being arrested, the load that was applied to flexible elongate 6's attachment to bracket 11, amounting substantially to the weight of person 1, is transferred to flexible elongate 10 thereby applying tangential loading on drum 8.

A protruding substantially cylindrical shaft formed about the axis of drum 8 is located in a corresponding substantially cylindrical hole in drum 8 such that drum 8 is able to rotate about the hole in chassis 12. Whilst radial plain bearing 108 is shown located between drum 8 and chassis 12, such a plain bearing may not be required depending on the robustness of the chassis and drum materials when loaded relatively highly in contrary radial directions. The speed of rotation of drum 8 is controlled by a central brake acting effectively between drum 8 and chassis 12 and also a centrifugal servo brake mechanism attached to chassis 12 and interactive with the central brake between drum 8 and chassis 12 to provide dynamic speed control to the rotational speed of drum 8 thereby allowing person 1 to be lowered at a controlled speed of descent. In some embodiments, chassis 12 may also be part of or attached to bracket 11 whereas in other embodiments chassis 12 may simply abut bracket 11 to resist interactive loading from related loading between harness attachment elongates 7*a* and 7*b* and flexible elongate 10 when person 1 is being suspended Bolt 101 has a hexagonal head 101*a* that is constrained within a hexagonal recess in drum 8 such that bolt 101 and drum 8 are constrained to rotate together about the central axis of drum 8 and also bolt 101 is prevented from moving along the central axis of drum 8 at least in one direction. Bolt 101 has a threaded region 101*b* that is engaged in a mating threaded region in a specially formed nut 102. Nut 102 passes through the centre of spur gear drive gear 103 and is frictionally adhered to drive gear 103 by means of a brake lining disc 104 and spring washer 105 such that relative rotational movement between nut 102 and drive gear 103 is prevented until opposing torque between nut 102 and drive gear 103 exceeds a predetermined limit. Thrust bearing 106 minimises friction effects between nut 102 and chassis 12. Friction reduction may also be desirable between bolt 101 and nut 102 whereby one or both threaded surfaces may be coated in a low friction material. When drum 8 together with bolt 101 rotate in the direction of tightening the mating screw surfaces between bolt 101 and nut 102, nut 102 will tend to unwind with respect to bolt 101 largely because of insufficient friction between nut 102 chassis 12. Therefore, as drum 8 rotates with respect to chassis 12, drive gear 103 will also tend to rotate in the same direction.

Drive gear 103 intermeshes with one or more further spur gears to drive spur gear 107 in FIG. 2 that is constrained to rotate with drive arm 108 that drives centrifugal brake shoes 9*a* and 9*b* against cylindrical friction brake lining 9*c*. As brake shoes 9*a* and 9*b* rotate, the mass and rotational velocity of each shoe will determine the magnitude of the radial resistance between each brake shoe and cylindrical friction brake lining 9*c* thereby applying tangential rotational resistance that is translated back through the gear train to drive gear 103. The resultant rotational drag on drive gear 103 will also apply a rotational drag on nut 102 such that ongoing rotation of drum 8 will tend to tighten bolt 101 into the mating thread in nut 102. Friction material 13 is positioned between opposing conical surfaces of drum 8 and chassis 12 and is constrained from rotating relative to either drum 8 or chassis 12. As nut 101 is drawn towards nut 102, drum 8 is also is also drawn towards friction material 13 thereby reducing the rotational velocity of drum 8. As the rotational velocity of drum 8 reduces further, the rotational velocity of drive gear 103 and ultimately the rotational velocity of centrifugal brake shoes 9*a* and 9*b* reduces thereby also reducing the tendency to tighten nut 102 onto bolt 101. Eventually, the centrifugal drag from brake shoes 9*a* and 9*b* will reduce to an extent whereby the thread of nut 102 tends to unwind with respect to bolt 101 allowing drum 8 to move away from friction material 13 thereby freeing drum 8 so that its rotational velocity can increase again. In this way, the centrifugal brake acts as a dynamic servo mechanism to regulate the braking force between drum 8 and friction material 13 dependent on the rotational velocity of drum 8 thereby also controlling the speed of deployment of flexible elongate 10 from drum 8.

The use of respective conical surfaces on chassis 12 and drum 8 either side of friction material 13 has several important advantages compared with a conventional arrangement using parallel flat interconnecting braking surfaces. The conical form is significantly stronger in compression along its central axis than parallel flat interconnecting surfaces and the braking resistance is also significantly greater for a given axial compression loading. The mating conical surfaces also tend to assist radial location between the drum and the chassis helping to resist contrary radial loading. Since the height rescue apparatus is normally carried attached to a person's harness, it is critically important that the weight and size of the apparatus is as small as possible. In practice, it has been found that the conical brake arrangement enables the drum to be made from lightweight and low cost plastic materials instead of the heavier and more costly metal alternatives. The amount of material in the chassis can also be minimised. The friction material 13 may be provided in one or more conical or part-conical portions or segments thereof disposed around the periphery of the drum or chassis.

Figure 4:
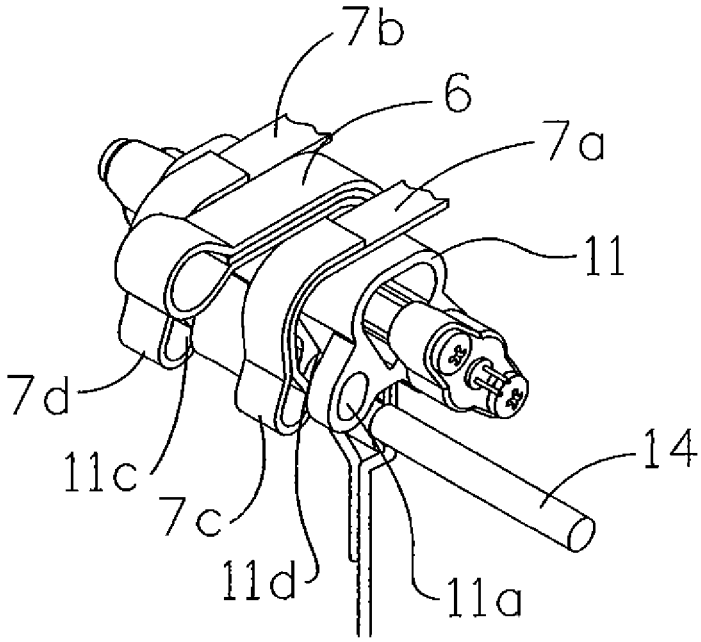
FIG. 4 shows the bracket and the first, second and third flexible elongate elements of the embodiment in FIG. 2 with the second elongate element disassembled from the bracket.
Figure 5:
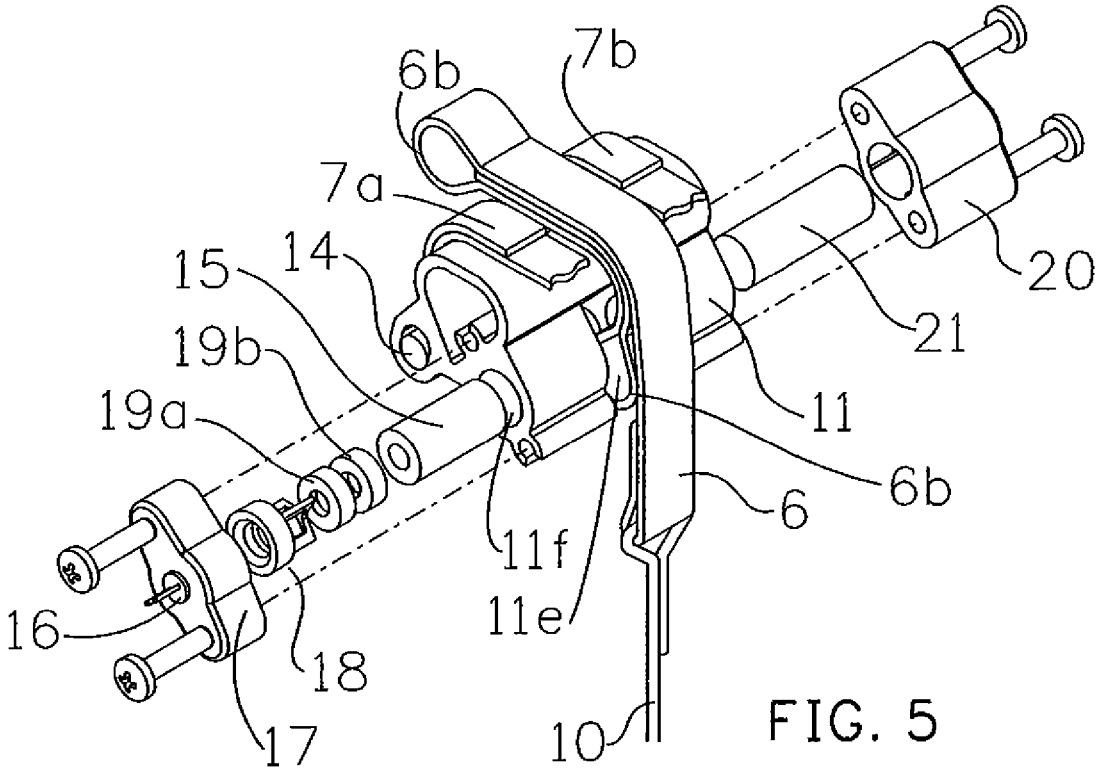
FIG. 5 shows the embodiment in FIG. 4 but with the first elongate element dissembled from the bracket.

The method of assembly of flexible elongate 7*a* and 7*b* to bracket 11 is shown in FIGS. 4 and 5. Bracket 11 is shown as a section of material typically extruded to form its length and with a through hole shown as 11*a* with its depth parallel to and extending the length of bracket 11. Material is cut away in two places 11*c* and 11*d* perpendicular to and typically equidistant from each end of bracket 11 into which looped ends 7*c* and 7*d* of flexible elongate 7*a* and 7*b* are positioned respectively so that their internal looped forms are coincident with hole 11*a*. Pin 14 is a cylindrical pin with a length substantially the same as or greater than the length of bracket 11 and with a cross section that is smaller than the cross sections of hole 11*a* and the inside of both looped ends 7*c* and 7*d* such that pin 14 may be inserted into hole 11*a* in bracket 11 and through both looped ends 7*c* and 7*d* effectively attaching flexible elongate 7*a* and 7*b* to bracket 11. Provision is normally made within casing 5*b* in FIG. 2 to constrain the ends of pin 14 to restrict any movement in a direction along its length relative to bracket 11.

FIG. 5 shows the method of assembly of flexible elongate 6 to bracket 11 and FIGS. 6*a*, 6*b* and 6*c* show the release means for releasing flexible elongate 6 from bracket 11. In FIG. 5, bracket 11 has a through hole shown as 11*f* with its depth parallel to and extending the length of bracket 11. Material is cut away at 11*e* typically midway along the length of bracket 11 into which loop end 6*b* of flexible elongate 6 is positioned so that the internal form of loop end 6*b* is coincident with hole 11*f*. Pin 15 is a substantially cylindrical pin that is inserted into hole 11*f* to an extent that straddles either end of cut out 11*e* and passes through looped end 6*b* in flexible elongate 6. Beyond one end of pin 15 there is an electrically initiated pyrotechnic actuator 16 that is held between collar 18 and actuator holder 17 that is attached by screws to one end of bracket 11. Between collar 18 and pin 15 there is one or more substantially cylindrical pistons shown as 19*a* and 19*b*. Immediately beyond the other end of pin 15 there is a cylindrical piece of foam 21 that is readily compressible and beyond this is arrestor 20 that is attached by screws to the end of bracket 11 opposing the end to which the actuator holder 17 is attached. Thus, as shown in FIG. 6*a*, the locations of pin 15 and pistons 19*a* and 19*b* along the length of hole 11*f* are effectively constrained between foam 21 and collar 18 ensuring that pin 15 straddles both sides of cut out 11*e* thereby providing the attachment of flexible elongate 6 to bracket 11.

The means for releasing the attachment of elongate 6 from bracket 11 is essentially to move pin 15 towards arrester 20 as shown particularly in FIGS. 6*b* and 6*c*. When a person is suspended after a fall, the load at the releasable attachment between flexible elongate 6 and bracket 11 is substantially equivalent to that exerted by the weight of the person with tools and equipment that the person may be carrying. This can amount to about 1.4 kN. One end of piston 19*a* has a protruding cylindrical portion with a smaller diameter than its outside diameter that engages in a hole in piston 19*b* and piston 19*b* also has a protruding cylindrical portion with a diameter smaller that its outside diameter that engages in a hole in one end of pin 15 such that when both pistons are compressed towards pin 15 the engaged cylindrical portions are sufficiently strong to overcome shear loading perpendicular to the axis of pin 15 as a result of the loading on flexible elongate 6 due to the weight of the person suspended. When electrical current of a sufficient magnitude and duration is passed across terminals 16*a* and 16*b* on actuator 16 as shown is FIG. 6*b*, the electrical current heats a wire resulting in detonation of explosive material within actuator 16 causing a rapid and significant increase of pressure within the cavity between the actuator and piston 19*a* such that both pistons are compressed with considerable force onto pin 15 and the pistons and pin 15 are propelled towards arrestor 20, readily compressing foam 21 and also overcoming friction between pin 15 and its contact with both bracket 11 and flexible elongate 6 due at least in part to the force exerted by the weight of the suspended person attached to flexible elongate 6. When piston 19*a* begins to pass into cut out 11*e*, as shown in FIG. 6*b*, the gas from the explosion readily escapes in cut out 11*e* thereby rapidly reducing the pressure on piston 19*a* such that further movement towards arrestor 20 of pistons 19*a* and 19*b* and pin 15 is as a result of developed momentum. Arrestor 20 has an aperture that is shaped to resist movement of pin 15 along its length so that the movement of pin 15 is effectively stopped within arrestor 20 when the length of pin 15 has substantially moved beyond cut out 11*e*. When pin 15 is arrested by arrestor 20 and piston 19*a* and 19*b* are no longer compressed towards pin 15, both pistons are urged into cut out 11*e* in the direction of arrow 65 in FIG. 6*c* by the load on flexible elongate 6 due to the weight of the suspended person such that both pistons are able to disengage from pin 15 thereby allowing flexible elongate 6 to become detached from bracket 11. In FIG. 5, one end of flexible elongate 10 is shown securely attached to flexible elongate 6 by means of interlinking closed loops although there are many other possible attachment methods including attachment by sewing flexible elongate 10 to flexible elongate 6. Flexible elongate 10 is also attached to a speed control means such as shown in FIGS. 2 and 3 so that when flexible 6 is detached from bracket 11, the person's weight is transferred from bracket 11 to flexible elongate 10 and the person is lowered to safety at a controlled speed.

The main purpose of pistons 19*a* and 19*b* is to minimise the distance required between the arrester end of bracket 11 and the end of arrestor 20 and/or the extent away from bracket 11 of pin 15 after it has been arrested. This is achieved by allowing the pistons to become an effective part of the length of pin 15 whilst it is being propelled towards arrestor 20. However, because the pistons are able to disengage from pin 15 and move away with flexible elongate 6, arrestor 20 only needs to arrest the length of pin 15. In practice it has been found that two pistons readily disengage from pin 15 although other embodiments could utilize one or more than two pistons. Clearly however, in embodiments where there is no particular desired limitation on the distance between the arrester end of bracket 11 and the end of arrestor 20 and/or the extent away from bracket 11 of pin 15 after it has been arrested, the length of pin 15 could be extended to replace pistons 19*a* and 19*b*.

Although arrestor 20 and actuator holder are described above as being attached to bracket 11 they may instead be attached to each other with bracket 11 located in between. In a rescue situation arrestor 20 is intended to stop pin 15 after the movement of pin 15 has been resisted by friction resulting at least in part by the suspended load of the person on flexible elongate 6. However, from a safety point of view, arrester 20 should be capable of stopping pin 15 without a person suspended on flexible elongate 6 in case actuator 16 is initiated in an unforeseen accident when a person is not suspended. Arrester 20 may arrest pin 15 in many different ways, one of which is achieved by plastic deformation of arrester 20 by pin 15 as shown in FIG. 6*c*. However, in other ways, arrester 20 could plastically deform pin 15 or else both pin 15 and arrester 20 could plastically deform in order to arrest pin 15. In principle, it is preferable for the arresting load to be substantially constant during the arresting process to minimise the load between arrestor 20 and the bracket 11 and/or actuator 16 so that arrestor 20 can be relatively lightly constructed.

FIG. 7*a* shows a portable radio frequency transmitter unit 45 that may be attached to a person's harness or key ring and which is wirelessly remote from the part of the height rescue apparatus that is worn on a person's harness. It incorporates a radio frequency transmitter energized by a small battery cell and has push button switches 40 and 41 used to effect the transmission of radio signals. FIG. 7*b* shows an overview of an electrical circuit and components that are typical housed within the part of the height rescue apparatus that is worn on a person's harness. Battery 29 is a source of electrical energy such as one or more battery cells. In practice, it has been found that lithium batteries are currently beneficial because they are small and lightweight in relation to their capacity, and the primary types as different from rechargeable types tend to have a long shelf life and can operate within useful extremes of ambient temperature. Fall switch 31 is a mechanically operated electrical switch that is closed when a person is suspended whilst wearing the height rescue apparatus and test switch 30 is operated only for routine testing and verifying the circuit and circuit components. Blocking diodes 22 and 23 serve to isolate electrically switch 31 from switch 30. Whilst both fall switch 31 and test switch 30 are open there is no current drawn from battery 31. Charge switch 33 is a switch that is only closed when fall switch 31 is also closed and charge switch 33 allows current to pass to and charge storage capacitor 34. Antenna 25 is a radio frequency receiving antenna connected to radio frequency receiver 26 that is able to receive radio frequency transmissions and decoder 27 is a radio frequency decoder that analyses the transmissions received by radio frequency receiver 26. If any radio signal conforms to a predetermined unique encoded signal, decoder 27 activates trigger pulse switch 28 that is a switch which when activated and closed allows capacitor 34 to discharge its stored electrical energy in order to detonate pyrotechnic actuator 16. Voltage converter 32 converts voltage from one level to a different level and is only required if battery 29 has an operating voltage that is different from the voltage required to operated the radio frequency circuit and associated components. Light emitting diode 43 is electrically connected to radio frequency receiver 26 so that the light emitting diode is energized to give a visual indication when radio frequency receiver 26 receives a radio signal.

When a person is suspended and requiring to be lowered to safety, fall switch 31 closes the circuit and allows charge storage capacitor 34 to store electrical charge. The person suspended or another person equipped with a portable radio frequency transmitter such as radio frequency transmitter 45 shown in FIG. 7*a*, transmits an encoded radio signal that is then received by antenna 25 and radio frequency receiver 26. The radio signal is then decoded by decoder 27 and, if accepted, decoder 27 activates trigger pulse switch 28 allowing capacitor 34 to discharge electrical current in order to initiate the detonation of actuator 16 and thereby release flexible elongate 6 from its attachment to bracket 11. An electrical resister may be included in the circuit in parallel with capacitor 34 in order to assist capacitor 34 to leak its charge in the event that it is accidentally charged such as if a person is intentionally suspended during a normal working activity.

Capacitor 34 is used in the electrical circuit because it can be charged by a relatively low performance battery 29 in order to deliver on discharge a relatively high level of electrical energy. This enables the use of a relatively small and lightweight battery having charge status that is not particularly critical except when it is nearing depletion. However, alternative embodiments may use one or more batteries that are capable of delivering sufficient electrical energy without the need for capacitor 34. High performance lithium batteries are predicted to become smaller and lighter as a result of active product development and so such alternative embodiments may become increasingly preferred in the future.

Routine circuit and component checking can be carried out by closing test switch 30 and enabling battery 29 to be connected to the circuit. Radio frequencies other than a predetermined unique encoded signal can then be transmitted from the portable radio frequency transmitter 45 shown in FIG. 7*a*. When a signal is received by radio frequency receiver 26, light emitting diode 43 is energized to indicate that both the radio frequency transmission and receiver functions are operational including the functioning of batteries within both the radio frequency transmitter 45 and battery 29, thereby concluding a successful test. The test circuit also typically includes checking of the circuit including the bridge wire within the pyrotechnic actuator 16 by passing a low current through the wire to check for unusual electrical resistance. FIG. 2 shows a push button 5*c* that is accessed from the outside of casing 5*b* and such a push button could typically and conveniently be used to operate test switch 30.

The radio frequency transmitter 45 in FIG. 7*a* is shown with two push button switches 40 and 41. There are essentially two transmitting operation conditions: one is to transmit a radio signal for test purposes and which is not a predetermined unique encoded signal and is therefore not accepted by decoder 27; the other condition is to transmit the predetermined unique encoded signal that is accepted by decoder 27. In order to provide for these two conditions it may be preferable to have two push button switches whereby one push button switch, such as push button switch 40, may be designated for transmitting signals for test purposes only and the other push button switch such as push button switch 41, or a combination of both switches 40 and 41, may then be configured to provide a unique encoded signal that is accepted by decoder 27. In practice, it has been found useful to allow the push button switch 40 to be easily accessible for routine testing but to arrange for push button switch 41 to be only easily accessible in an emergency situation when a person needs to be rescued. This reduces the possibility of accidental initiation of actuator 16. For example, access to switch 41 could be temporarily restricted by a cover that would need to be removed in an emergency requiring a person to make a conscious action before accessing switch 41.

In an alternative embodiment, there may be no fall switch 31 and the circuit including battery 29 and the radio frequency receiver may be enabled with a simple switch or else remain permanently closed so that electrical energy is continually drawn albeit at low levels from battery 29. Whilst this has the advantage of avoiding the need for fall switch 31 there are also a number of disadvantages. Firstly, there is the need to maintain sufficient charge in battery 29 such as by using rechargeable batteries that are regularly recharged for use. Secondly, there would be no differentiation between a person working normally and a person suspended as was provided by fall switch 31 so that it would be inadvisable to use a common unique radio transmission code across a number of people equipped with height rescue apparatuses. If each person were to require their his or her own unique radio transmission and receipt code, complications could arise in locating and pairing each transmitter with each receiver in an emergency situation particularly if a battery in a critical radio frequency transmitter was depleted. However, if fall switch 31 was used and the unique code was shared across both transmitters and receivers it would be comparatively easy to locate a portable transmitter for use in an emergency.

In typical embodiments it is common for anyone equipped with the height rescue apparatus to carry a radio frequency transmitter that can be used to initiate their own rescue or to initiate a colleague's rescue. However, other embodiments may include a different method for a person to initiate a self-rescue such as by operating an electrical switch that is directly wired to the electrical circuit in the height rescue that could then be operated in a number of alternative ways such as being pushed, pulled and/or operated by means of a pull cord. This would be useful in the event that the person's radio frequency transmitter was not functioning properly or if it were difficult for a person to operate a radio frequency transmitter when suspended in a harness.

FIG. 7*c* shows a partially cutaway view of one end of bracket 11 where, as in FIG. 4 with flexible elongates 7*a* and 7*b*, flexible elongate 7*b* and 7*a* (not visible in FIG. 7*c*) are lengths of flexible elongate with closed loops formed at one end and each loop located in cut away portions along the length of bracket 11. Hole 11*a* is elongated in section and extends the entire length of bracket 11. Pin 14 is a cylindrical pin typically at least as long as the length of bracket 11 and is inserted into hole 11*a* and through the closed loops in flexible elongate 7*a* and 7*b* thereby securing flexible elongate 7*a* and 7*b* to bracket 11. The other end of both flexible elongate 7*a* and 7*b*, as different from the ends secured to bracket 11, are typically attached to a harness worn by a person or, as shown in FIG. 11*b*, attached to a secure anchorage at loop 7*a*. The elongate section of hole 11*a* allows pin 14 to move to one end of the elongation when pin 14 is urged in the direction of arrow 47 and conversely, pin 14 moves to the other end of the elongation when flexible elongate 7*b* is pulled in the direction of arrow 46 about the outer surface of bracket 11. An electrical switch is linked to the movement of pin 14 in elongated hole 11*a* such that when pin 14 is urged to an extent in the direction of arrow 47 the switch is held open and, conversely, when pin 14 is urged to the opposite extent in elongated hole 11*a* the switch is closed.

When a person is using the height rescue apparatus in normal use, a compression spring not shown in FIG. 7*c* urges pin 14 to move in the direction of arrow 47 typically to one extent of the elongated hole 11*a* such that the electrical switch is open. However, when flexible elongate 7*b* attached to a person's harness is loaded in the direction of arrow 46 as would occur when a person is suspended and/or when flexible elongate 7*b* is loaded beyond a predetermined threshold, pin 14 moves to the other extent in elongated hole 11*a* thereby closing the electrical switch. Clearly there are many other possible embodiments that could provide a switch that closes the circuit when a predetermined threshold of load is exceeded between a person's harness and safety line. One such embodiment of such a switching operation in shown in FIGS. 7*d* and 7*e*.

In FIGS. 7*d* and 7*e* spring 82 is a helically wound compression spring that is mounted in housing 83. Housing 83 is securely attached to bracket 11 at fixing positions 85*a* and 85*b* and is shown incorporating provision for pyrotechnic actuator 16. Pin 14 in FIG. 7*c* is also shown in FIG. 7*d* and pin end 14*a* is a reduced diameter portion of the end of pin 14. Flexible elongate 7*b* as shown in FIG. 7*c* is looped around pin 14. Spring 82 bears between housing 83 and pin end 14*a* such that pin 14 is constrained in the direction of arrow 47 in FIG. 7*c* bearing on one end of slot 11*a* in bracket 11. Lever arm 84 has hole 84*b* that is located on pin end 14*a* such that it can rotate about the cylindrical axis of pin end 14*a*. Abutment 84*a* is a part of or an attachment to lever arm 84 and has radial surfaces that sit between edge locations 83*a* and 83*b* in casing 83 thereby constraining the rotation of lever arm 84 about pin end 14*a* with respect to casing 83. Switch 87 is a standard type of electrical reed switch that is closed by a magnet being passed sufficiently close to it and then opened when the magnet is moved away. Such as magnet is shown as magnet 86 that is attached to lever 84. Switch 87 is typically mounted on a printed circuit board such as circuit board 88. In FIG. 7*d*, magnet 86 is sufficiently far away from switch 87 such that switch 87 remains open. In FIG. 7*e*, flexible elongates 7*a* and 7*b* are loaded in the direction of arrow 46 tending to move pin 14 along slot 11*a* shown in FIG. 7*c* whilst the movement of pin 14 is then resisted by compression spring 82. When the loading on elongate 7*a* and 7*b* is of a sufficient magnitude to overcome the resistance provided by compression spring 82, pin 14 moves to the other end of slot 11*a* in bracket 11 shown in FIG. 7*c* resulting also in the movement of lever 84 at its hole 84*b* connecting it to pin 14. However, the mechanical relationship between abutment 84*a* in lever arm 84 and edge locations 83*a* and 83*b* on housing 83 causes magnet 86 attached to lever arm 84 to swing about the axis of pin 14 sufficiently close to close switch 87.

In FIG. 7*b*, both test switch 30 and fall switch 30 could be one and the same. Reed switch 87 in FIGS. 7*d* and 7*e* could be used simply to initiate the test function by bringing a magnet from outside the rescue apparatus casing and placing it close to switch 87 to close switch 87 and initiate the test function. For convenience, such a magnet could be incorporated into the radio transmitter shown in FIG. 7*a*. This enables the test function to be initiated without needing any mechanical actuation such a push button that may need to penetrate the rescue apparatus casing and be vulnerable to things such as misuse and weather ingress.

In embodiments that include the test function for testing part or all of the electrical circuit operation, it is useful to have a means for recording when the test procedures were carried out as part of any examination in the event that the invention failed to operate correctly. Such a means for recording typically includes a digital clock with date facility and also digital memory to store the time and date that all or some of the test procedures were carried out. Usually, the most significant data recorded is to do with the most recent test procedure although a log of all test procedures can be useful for gaining information on how closely the required testing procedure has been adhered to. The digital clock is normally powered in circuit permanently.

Whilst fall switch 31 in FIG. 7*b* is useful for conserving electrical energy for use when a person is suspended, it may also be connected to an audible and/or visual signal in order to attract attention and communicate that a person may be suspended following a fall. The audible and/or visual signal would also be useful for warning a person intentionally suspended during normal working that fall switch 31 has been closed and that capacitor 34 is charged. A further embodiment of the invention could include a radio frequency transmitter within the height rescue apparatus worn on a harness such that the transmitter could transmit a signal when fall switch 31 is closed. This would be useful where a person is working at height alone as is common for example with telecommunication workers servicing pylons. Such a signal could then be received in various ways and various locations. For example, the signal could be received within a building or vehicle to alert that someone may be suspended in a harness nearby. Alternatively, the signal could be received and passed to a communication device such as a mobile telephone that could then, if necessary, automatically contact and alert one or more other devices to attract attention and communicate that someone may be suspended wearing a harness.

All electrical components referred to above are standard and in use. However, in order to provide a small and lightweight package for the unit worn on a harness it may be preferable to incorporate much of the electrical circuit and component on a ceramic hybrid circuit with the likely exception of components such as battery 29 and capacitor 34. Such a hybrid circuit may be made to a unique specification.

FIGS. 8*a* through to 9*b* show a possible embodiment for attaching the height rescue apparatus simply and securely to a harness. FIGS. 8*a* and 8*b* show an attachment to crossed webbing straps of a harness typically in a position close to the middle or upper back of a person wearing the harness. FIGS. 9*a* and 9*b* show an attachment to a substantially horizontal strap that may be in a position at the front of a person wearing a harness such as a belt around a person's waist or more typically across a person's chest.

In FIGS. 8*a* and 8*b*, webbing straps 2*a* and 2*b* are elements of a typical harness worn by a person such that the ends of webbing straps 2*a* and 2*b* are securely attached to other elements of the harness. Webbing straps 2*a* and 2*b* cross over each other as shown and at a position close to the middle or upper region of a person's back. Each strap is passed through elongated apertures in a bracket such as bracket 50 to locate the straps relative to each other and to resist movement of either or both straps relative to bracket 50. Bracket 50 may then be attached to casing 5*a* of the height rescue apparatus at fixing locations such as 51, 52 and 53 such that it is able to detach from casing 5*a* when one or more predetermined magnitudes and respective directions of load are exceeded as would occur in at least some instances when a person is arrested from a significant fall. Flexible elongate 7*a* and 7*b* are attached to bracket 11 as shown in FIG. 4 and are inclined across the surface of bracket 11 and joined together to form a closed loop around both webbing straps 2*a* and 2*b* effectively retaining webbing straps 2*a* and 2*b* securely with respect to bracket 11. In an alternative embodiment as shown in FIG. 9*b* flexible elongate 7*a* and 7*b* is integrated into a single length of flexible elongate that is looped around harness straps 2*a* and 2*b* and attached at each end to bracket 11.

In FIGS. 9*a* and 9*b* webbing strap 2 is a typical element of a harness worn by a person such that both ends of webbing strap 2 are securely attached to other elements of the harness. Webbing strap 2 is located between a bracket 55 and the height rescue apparatus casing 5*a* such that when bracket 55 is attached to casing 5*a*, typically at positions 56, 57 and 58, the height apparatus casing is effectively supported on webbing strap 2. The attachment of bracket 55 to casing 5*a* is arranged such that bracket 55 is able to detach from casing 5*a* when one or more predetermined magnitudes and respective directions of load are exceeded as may occur when a person is arrested from a significant fall. Flexible elongates 7*a* and 7*b* are preferably integrated as one length of flexible elongate 7 that is looped around harness strap 2 and then attached at each end as shown in FIG. 4 to bracket 11 such that webbing strap 2 is effectively securely retained by flexible elongate 7 with respect to bracket 11.

In FIGS. 8*a* to 9*b* flexible elongate 6 is attached to bracket 11 as shown in FIG. 5 and safety line 3 in FIGS. 1*a* and 1*b* is securely attached to loop 6*a* in flexible elongate 6. When a person is intentionally suspended from safety line 3 whilst working normally, the harness is securely retained by flexible elongate 7 or elongates 7*a* and 7*b* without causing brackets 50 or 55 to detach from casing 5*a*. However, when a person is being arrested from a fall, brackets 50 or 55 may become detached from casing 5*a* in order to allow the fall loads to be substantially sustained between both flexible elongate 6 and also 7 (or 7*a* and 7*b*). In practice, the attachments securing safety line 3 to the harness provided by flexible elongate 6, 7 (or 7*a* and 7*b*) and bracket 11 are required to withstand loads of at least 22 kN in order to comply with current international safety standards.

The attachment between a person's harness and the safety line as provided by the attachments of flexible elongates 6 and 7 (or 7*a* and 7*b*) and bracket 11 is required to withstand fall arrest loading irrespective of the various possible configurations and attitudes that a person's body might assume whilst being arrested. For example, a person might fall with feet or head closest to the ground or with the body in a prone or near horizontal disposition. However, it is preferable to minimise any load during a fall that may be transferred to the casing of the height rescue apparatus particularly load that may result in rotation of the casing such that the casing could bear onto the person's body. This could cause injury to the person and also apply significant loading on the height rescue casing itself and possibly compromise the subsequent safe operation of the height rescue apparatus. It is also preferable for the casing of the height rescue apparatus to be of a relatively light construction in order to minimise its weight when carried on a person's harness. Accordingly, FIG. 10*a* shows the height rescue apparatus in a typical attitude where a person equipped with the height rescue apparatus is being arrested from a fall with the person's feet closest to the ground whereas FIG. 10*b* shows the height rescue apparatus in a typical attitude where the person is being arrested from a fall with the person's head closest to the ground and FIG. 10*c* shows the height rescue apparatus in a typical attitude where the person is falling with the person's body in a substantially prone or horizontal disposition.

In FIGS. 10*a*, 10*b* and 10*c*, flexible elongate 6 and 7 are shown attached to bracket 11 as previously described with respect to FIGS. 4 and 5 such that flexible elongates 6 and 7, as a consequence of their inherent flexibility, assume the outer form of bracket 11 when passed over the surface of bracket 11 under tension and in a direction substantially perpendicular to the length of bracket 11. The surface of bracket 11 in contact with flexible elongates 6 and 7 is preferably at least partially cylindrical along the length of bracket 11 to provide a smooth contact surface. When flexible elongate 6 is attached to a safety line and flexible elongate 7 is attached to harness 2, both flexible elongates pass over the surface of bracket 11 in opposing directions such that when a load is applied between the safety line attached to flexible elongate 6 substantially in the direction of arrow 60 and between the attachment of harness 2 to flexible elongate 7 substantially in the direction of arrow 61 the flexibility of both elongates about bracket 11 allows alignment of load without significant rotational load tending to rotate casing 5 typically about an axis perpendicular to the plane of FIGS. 10*a* to 10*b*. In FIG. 10 there is a small tendency for casing 5 to rotate away from a person wearing harness 2 in the direction of arrow 70 and, in FIG. 10*b*, there is a small tendency for casing 5 to rotate in the direction arrow 71 towards a person falling head first whereas in FIG. 10*c* there is little if any tendency for casing 5 to rotate. UK Patent Application GB 2414005 discloses articulating elements in its FIGS. 14*a* to 14*e* that attempt to achieve the same effect but the lack of flexibility within each element requires them to articulate about a complex arrangement of pivoting axes. Such elements and their pivoting arrangement will therefore need to be relatively substantial mechanical components being typically heavy and expensive to manufacture in order to satisfy the various load magnitude requirements in all attitudes that a person's body may be disposed in a fall event.

FIGS. 11*a* and 11*b* illustrate how the invention may be located at any position between a secure anchor and a person's harness. Flexible elongate 7 may be attached at its end 7*a* to a secure anchorage or to safety line that is then attached to a secure anchorage and flexible elongate 6 may be attached at its end 6*a* to a harness or to a safety line that is then attached to a person's harness. Both flexible elongates 6 and 7 are attached to bracket 11 and flexible elongate 6 has a releasable attachment to bracket 11 as referred to in FIGS. 6*a*, 6*b* and 6*c*. In the event that the person needs to be rescued following a fall, flexible elongate 6 is released from bracket 11 enabling flexible elongate 6 to move away from bracket 11 and the secure anchorage. Flexible elongate 6 is attached to rescue line at its end 6*b* that is then deployed from a drum in casing 5 at a controlled speed as referred to in FIGS. 2 and 3 so that the person is lowered to the ground at a controlled speed. The advantage of the embodiments in FIGS. 11*a* and 11*b* is that the weight of casing 5 and its contents is effectively carried by the secure anchorage rather than by the person wearing the harness. The embodiment in FIG. 11*b* is similar in most respects to that in FIG. 11*a* except that flexible elongate 7 is held close to casing 5 by bracket 81 so that flexible elongate 6 is located at the lower end of casing 5 thereby reducing any tendency for casing 5 to rotate when fall loads are applied to both flexible elongate 6 and 7.

Clearly, a further embodiment is possible whereby flexible elongate 6 is attached to the secure anchorage instead of to the person's harness and flexible elongate 7 is attached to the person's harness instead of to the secure anchorage such that when flexible elongate 6 is released from bracket 11, both bracket 11 and casing 5 move away from the secure anchorage. This has the disadvantage that casing 5 would need to be sufficiently strong to resist being damaged if it collided with anything in the descent path or if it traversed an edge during the descent. Also, this further embodiment would result in rescue line being substantially stationary along its length with respect to any static obstruction or edge that it may collide with in the descent path so that the portion of rescue line in contact with any such obstruction or edge would tend to be subject to greater wear than if the length of the rescue line, as would occur in the embodiments in FIGS. 11*a* and 11*b*, were to move across any obstruction or edge thereby effectively distributing any wear along the length of the rescue line.

In FIGS. 8*a* to 9*b* bracket 50 and 55 are able to detach from casing 5*a* in order to enable fall loads to be sustained between flexible elongate 6 and both 7*a* and 7*b* and their attachment to the harness straps rather than between brackets 50 or 55 and the said harness straps. This may be disadvantageous if either bracket 50 or 55 became detached from casing 5*a* unintentionally and could not be easily re-attached. FIGS. 12*a* to 12*d* show an alternative embodiment where the rescue apparatus casing is able to move with respect to brackets such as bracket 50 and 55 in FIGS. 8*a* to 9*b* attached to the harness straps. FIG. 12*a* shows a bracket 90 that has shaped apertures 91*a*, 91*b* and 91*c* into which the harness straps can be located. The apertures allow harness straps 2*a* and 2*b* in FIG. 12*b* to be located at any point along the length of each strap into apertures 91*a* to 91*c* so that bracket 90 could be fitted onto an existing harness rather than needing to be assembled to bracket 90 during construction of the harness. However, any or all apertures 91*a*, 91*b* and 91*c* could be closed such that harness straps 2*a* and 2*b* can only be threaded through the apertures by initially threading the ends of each harness strap such as would be necessary during the harness construction. Collar 92 is shown as a flexible elongate, although it could be any other material, that is threaded around both harness straps 2*a* and 2*b* to form a closed looped secure attachment to both harness straps. Elastic rope 93 is a closed loop of resilient elongate whereby loop ends 93*a* and 93*b* are passed through holes 91*d* and 91*e* respectively. In FIG. 12*c*, casing 5 is located in bracket 90 such that it can move in the direction of either arrow 95 or 96 with respect to bracket 90. Loop ends 93*a* and 93*b* of elastic rope 93 in FIG. 12*b* are then attached to attachment features on either opposing side of casing 5 as seen as 94*a* and 94*b* in FIG. 14, so that casing 5 is effectively attached to bracket 90 with the ability to move against elastic resistance provided by elastic rope 93 in the direction of either arrow 95 or arrow 96. In normal use, elastic rope 93 and also the friction between the interconnecting surfaces of bracket 90 and casing 5 resist the weight of the rescue apparatus. This is more desirable than simply supporting the weight of the rescue apparatus by webbing straps 7*a* and 7*b* because casing 5 would tend to hang loose and in an awkward manner. In FIG. 12*d*, flexible elongate loop 6 is attached to a lanyard and loaded in the direction of arrow 96. Collar 92 is securely attached to harness straps 2*a* and 2*b* and also securely attached to flexible elongates 7*a* and 7*b* such that load between flexible elongate loop 6 and harness straps 2*a* and 2*b* effectively withstands the load applied whilst arresting the fall of a person wearing such harness. During a fall, flexible elongate loop 6 is able to align readily with the harness straps 2*a* and 2*b* as a result of the ability for casing 5 to move with respect to bracket 90. FIG. 12*d* shows casing 5 moving in the direction of arrow 96 as would occur in a fall with a person's feet being closest to the ground. Alternatively, if a person were to fall head first then casing 5 would tend to move in the direction of arrow 95 shown in FIG. 12*d* relative to bracket 90. In any fall situation the relative load magnitude between bracket 90 and casing 5 is typically small as provided by the elastic resistance of elastic rope 93 as a result of movement between bracket 90 and casing 5 allowing flexible elongate 6 and harness straps 2*a* and 2*b* to align.

Whilst it is important that the height rescue apparatus is lightweight, it is also beneficial if it is comfortable to wear in conjunction with a harness. FIGS. 13*a*, 13*b*, 13*c* and 13*d* show the invention attachment to the harness incorporating a flexible pouch 110. Flexible pouch 110 is made of a flexible material and at least partially envelopes casing 5, casing 5 being the rescue apparatus casing. FIG. 13*a* shows a view of flexible pouch 110 in normal use cut away to reveal casing 5 and the attachment of the rescue apparatus to the harness. Harness straps 2*a* and 2*b* are threaded through bracket 112 typically in the region where straps 2*a* and 2*b* cross over. Bracket 112 is a standard component that locates the cross over of the straps 2*a* and 2*b* such that straps 2*a* and 2*b* present an attachment loop 114. The location of straps 2*a* and 2*b* in bracket 112 typically has a means for providing some resistance to movement of attachment loop 114 along the length of straps 2*a* and 2*b* in the event that a person falls. This is useful to ensure that the centre of gravity of the person is below attachment loop 114 when the person has come to rest after a fall so that the person is suspended with his or her head uppermost. Link 113 has means for securely attaching attachment loop 114 to flexible elongate 7*a* and 7*b* that are securely attached to the rescue apparatus as shown in FIG. 4. Flexible pouch 110 typically envelops casing 5 and part of the length of each strap 2*a* and 2*b* in the region of attachment loop 114 and may in some embodiments also at least partially envelop attachment loop 114 including bracket 112 and link 113. An aperture 111 in flexible pouch 110 is shown to enable flexible elongate 6 to be presented for attachment to a lanyard.

In preferred embodiments, a resisting means is provided to resist movement of flexible pouch 110 relative to harness straps 2*a* and 2*b* such that the weight of the rescue apparatus as contained substantially in casing 5 is supported in normal use by flexible pouch 110. In practice, this is significantly more comfortable in use than simply suspending casing 5 by webbing straps 7*a* and 7*b* such that casing 5 is free to swing and hang in an awkward manner. As has already been mentioned, bracket 112 may usefully resist movement relative to itself of both harness straps 2*a* and 2*b* so that the cross over of harness straps 2*a* and 2*b* presenting loop 114 is also resisted from moving relative to harness straps 2*a* and 2*b*. Flexible pouch may then be arranged to envelop both harness straps 2*a* and 2*b* either above, below or both above and below bracket 112 so that it is also resisted from movement relative to bracket 112. In some embodiments, bracket 112 may be simply incorporated into or be part of flexible pouch 110. An alternative method for resisting movement of flexible pouch 112 may be to attach flexible pouch 110 to harness straps 2*a* and 2*b* so that the attachment resists its movement relative to the harness. However, harnesses typically require adjustment to fit different various sizes of people so it may be beneficial to allow each harness strap to move through flexible pouch 112 for adjustment purposes. FIG. 13*d* shows a person wearing an embodiment of the rescue apparatus enveloped in flexible pouch 110. Flexible pouch 110 is shown enveloping harness straps 2*a* and 2*b* both above and below the point at which the straps cross such as at locations 110*a*, 110*b*, 110*c* and 110*d* so that up and down movement of flexible pouch 110 relative to the harness is resisted. Flexible elongate 6 emerges through aperture 111 for attachment typically to a lanyard. Enveloping the rescue apparatus in flexible pouch 110 helps to protect it from knocks and the elements including rain, ultraviolet degradation large temperature variations.

FIGS. 13*b* and 13*c* illustrate the effect of loading on the arrangement in FIG. 13*a* in the event of falling. In FIG. 13*b*, load is shown being applied to flexible elongate 6 in the direction of arrow 115 as would occur if someone were to fall with his or her head uppermost. Flexible pouch 110 flexes and changes form to allow casing 5 to move upwards relative to the harness to enable the fall load to be resisted by flexible elongate 6 and flexible elongates 7*a* and 7*b* and to allow them to align accordingly. In FIG. 13*c*, the load is shown being applied to flexible elongate 6 in the direction of arrow 116 as would occur if someone were falling head first with his or her feet uppermost. Again, flexible pouch 110 flexes and changes form to allow flexible elongate 6 and flexible elongates 7*a* and 7*b* to resist the relatively high fall load and to align accordingly. Occasionally, in use, a person will either accidentally or intentionally suspend in a harness such as in FIG. 13*b*. It is therefore useful if flexible pouch 110 can also be made from an elastic material such as neoprene or rubber so that it is able to return to the form for normal use such as in FIG. 13*a* whereby the weight of the rescue apparatus is substantially supported by flexible pouch 110.

When a person is being lowered after having been suspended following a fall, rescue line is unwound at a controlled speed and deployed from an aperture in the casing of the rescue apparatus between both elongate 7*a* and 7*b* that are attached to the person's harness. Therefore, it is important that the rescue line is separated from elongates 7*a* and 7*b* to avoid any rubbing and potential damage and degradation in the strength of any elongate. In FIG. 14, walls 98*a* and 98*b* are abutments on casing 5 that physically separate elongates 7*a* and 7*b* and rescue line 10 so that when rescue line 10 is deployed from casing 5 it cannot rub against either elongates 7*a* and 7*b*.

Any reference above to flexible elongate includes flexible elongate of any useful cross section, construction and material. In practice, it is preferable for the flexible elongate to be lightweight and compact.

The described embodiments may differ in their details but they are linked by common operating principles. Accordingly, it will be understood by the person skilled in the art that the technical features described with reference to one embodiment will normally be applicable to other embodiments.

Where the invention has been specifically described above with reference to these specific embodiments, it will be understood by the person skilled in the art that these are merely illustrative although variations are possible within the scope of the claims, which follow.

The invention claimed is:

1. A height rescue apparatus having a fall arrest function and a lowering function, comprising a bracket and a flexible load element comprised of a flexible material, releasably secured to the bracket at a first position during the fall arrest function, a flexible harness element attached to the bracket to retain a harness, one end of a safety line in use being attached to the flexible load element and the other end of the safety line in use being attached to a secure anchorage, a flexible elongate element being secured at one end to the flexible load element and at the other end to at least one speed control means and release means for releasing the flexible load element from said first position after a fall has been arrested, such that when the flexible load element is released the flexible load element is able to move relative to the bracket during the lowering function at a controllable speed so as to provide a controlled speed of descent.

2. The height rescue apparatus as claimed in claim 1 wherein the flexible load element and the flexible harness element are comprised of webbing straps.

3. The height rescue apparatus as claimed in claim 2 wherein the webbing straps are made from non-metallic material.

4. The height rescue apparatus as claimed in claim 2 wherein the flexible load element provides a first loop for attachment to the safety line and a second loop for attachment to the flexible elongate element.

5. The height rescue apparatus as claimed in claim 4 wherein the flexible load element provides a load loop intermediate the first and second loops for said releasable attachment to the bracket.

6. The height rescue apparatus as claimed in claim 1, wherein the flexible load element is held relative to the bracket by means of a pin which is received in a bore in the bracket and which is adapted to move along the bore to release the flexible load element.

7. The height rescue apparatus as claimed in claim 6 wherein a recess is provided in the bore of the bracket for receiving part of said flexible load element.

8. The height rescue apparatus as claimed in claim 6 wherein the pin is released by pyrotechnic means.

9. The height rescue apparatus as claimed in claim 8 wherein the pyrotechnic means incorporates retaining means for retaining the pin after it has been released.

10. The height rescue apparatus as claimed in claim 9 wherein the retaining means comprises an arrestor at one end of the bore.

11. The height rescue apparatus as claimed in claim 10 wherein the arrestor comprises or includes a deformable material or deforms the pin or a combination of any of these in order to absorb the momentum of the pin.

12. The height rescue apparatus as claimed in claim 6, wherein the flexible harness element forms with the bracket an opening for attachment to the harness and through which opening the flexible load element extends.

13. The height rescue apparatus as claimed in claim 12 wherein the flexible harness element has a loop at each end, which loops are secured relative to the bracket by means of a retained pin received in a further bore in the bracket, recesses being provided in the bracket for receiving the loops of the flexible harness element.

14. The height rescue apparatus as claimed in claim 12 wherein the bracket provides adjacent contact surfaces for the flexible load element and the flexible harness element, which elements extend in opposite directions past each other.

15. The height rescue apparatus as claimed in claim 14 wherein the contact surfaces are smoothly contoured.

16. The height rescue apparatus as claimed in claim 1, wherein a basic form of the bracket is an extrusion.

17. The height rescue apparatus as claimed in claim 1, wherein the flexible elongate element is organised within a housing which is secured relative to the bracket.

18. The height rescue apparatus as claimed in claim 17 wherein the elongate element is wound on a drum mounted for rotation within and relative to the housing, the speed of rotation of the drum being controlled by said at least one speed control means.

19. The height rescue apparatus as claimed in claim 18 wherein said at least one speed control means includes a centrifugal brake mechanism.

20. The height rescue apparatus as claimed in claim 19 wherein said at least one speed control means incorporates a conical brake mechanism.

21. The height rescue apparatus as claimed in claim 20 wherein the centrifugal brake mechanism comprises said drum being threadedly attached to a nut which frictionally engages a drive gear which is resiliently urged towards the nut, the drive gear driving in rotation a shoe drive having shoes mounted thereon for engagement with a corresponding cylindrical friction lining, one or more at least part-conical friction members or segments thereof being provided between the drum and the housing.

22. The height rescue apparatus as claimed in claim 1, wherein the harness comprises a harness bracket and the harness bracket is attached to a housing by one or more resilient flexible members.

23. The height rescue apparatus as claimed in claim 22 wherein the or one of the resilient flexible members comprises a closed loop which extends through an opening in the harness bracket and has its ends looped around retaining posts at opposite sides of the housing.

24. The height rescue apparatus as claimed in claim 22 wherein the apparatus is at least partially enveloped within a resilient pouch which envelopes part of the harness, the harness and an end of the flexible load element projecting from the pouch.

25. The height rescue apparatus as claimed in claim 24 wherein the pouch is made from rubber or synthetic rubber.

26. The height rescue apparatus as claimed in claim 1, wherein the release means is manually or remotely operated.

27. The height rescue apparatus as claimed in claim 26 wherein the release means incorporates a fall switch to detect a fall, release being prevented unless a fall is detected.

28. The height rescue apparatus as claimed in claim 27 wherein the fall switch incorporates a mechanism which acts against a resilient member when the flexible harness element is subjected to a predetermined load.

29. The height rescue apparatus as claimed in claim 1, wherein the load element is releasably secured to the bracket.

* * * * *